US006990968B2

(12) United States Patent
Nagaishi et al.

(10) Patent No.: US 6,990,968 B2
(45) Date of Patent: Jan. 31, 2006

(54) ENGINE FUEL INJECTION AMOUNT CONTROL DEVICE

(75) Inventors: Hatsuo Nagaishi, Zushi (JP); Takashi Nakazawa, Kawasaki (JP); Kazuhiko Abe, Kawasaki (JP); Yuji Sasaki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 32 days.

(21) Appl. No.: 10/895,426

(22) Filed: Jul. 21, 2004

(65) Prior Publication Data

US 2005/0051147 A1 Mar. 10, 2005

(30) Foreign Application Priority Data

Jul. 24, 2003 (JP) ..... 2003-279030
Aug. 1, 2003 (JP) ..... 2003-285252
Aug. 22, 2003 (JP) ..... 2003-298763

(51) Int. Cl.
*F02D 41/04* (2006.01)

(52) U.S. Cl. ..... 123/672; 123/480; 123/492; 701/103

(58) Field of Classification Search ..... 123/480, 123/492, 493, 672, 676; 701/103
See application file for complete search history.

(56) References Cited

U.S. PATENT DOCUMENTS 5,080,071 A * 1/1992 Minamitani et al. ..... 123/492
5,404,856 A * 4/1995 Servati ..... 123/478
5,529,043 A * 6/1996 Nagaishi et al. ..... 123/478
5,584,277 A * 12/1996 Chen et al. ..... 123/492
5,690,087 A * 11/1997 Schumacher et al. ..... 123/675
6,067,965 A * 5/2000 Trumpy et al. ..... 123/480
6,695,895 B2 * 2/2004 Hyodo et al. ..... 123/519

FOREIGN PATENT DOCUMENTS

JP 3-134237 A 6/1991
JP 9-303173 A 11/1997

* cited by examiner

*Primary Examiner*—Erick Solis
(74) *Attorney, Agent, or Firm*—Foley & Lardner LLP

(57) ABSTRACT

An intake port (4) is connected to a combustion chamber (6) of an internal combustion engine (1) via an intake valve (15), and a volatile liquid fuel is injected from a fuel injector (21) provided in the intake port (4). The controller (31) calculates a suspension ratio in the combustion chamber (5) of the injected fuel according to the particle diameter of the injected fuel (52–56), calculates an amount of fuel burnt in the combustion chamber (6) based on the suspension ratio (57), calculates a target fuel injection amount based on the burnt fuel amount (75, 76), and controls a fuel injection amount of the fuel injector (21) based on the target fuel injection amount (76). Precise fuel injection control can be performed without performing adaptation experiments, based on particle diameter data for different fuel injectors by taking the particle diameter as a parameter.

46 Claims, 26 Drawing Sheets

32 AIR FLOW METER
33 CRANK ANGLE SENSOR
34 CAM SENSOR
42 ACCELERATOR PEDAL DEPERESSION SENSOR
43 CATALYST TEMPERATURE SENSOR
44 INTAKE AIR TEMPERATURE SENSOR
45 WATER TEMPERATURE SENSOR
46 PRESSURE SENSOR
47 AIR/FUEL RATIO SENSOR
48 EXHAUST GAS TEMPERATURE SENSOR
148 ATMOSPHERIC PRESSURE SENSOR

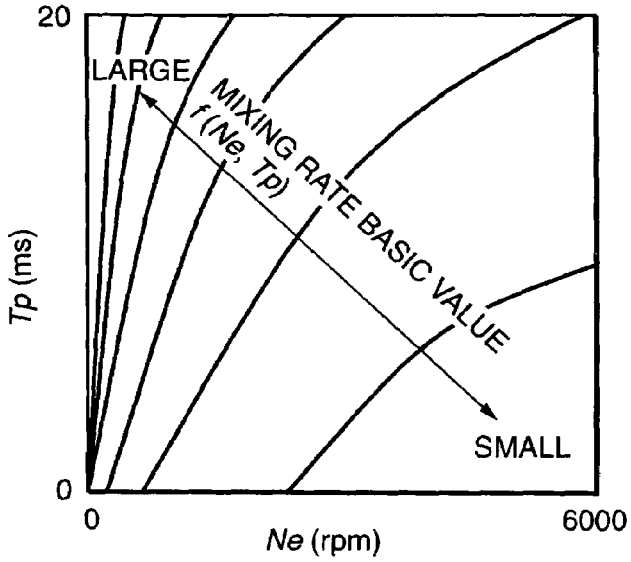
FIG. 30
FIG. 31A
FIG. 31B
FIG. 31C
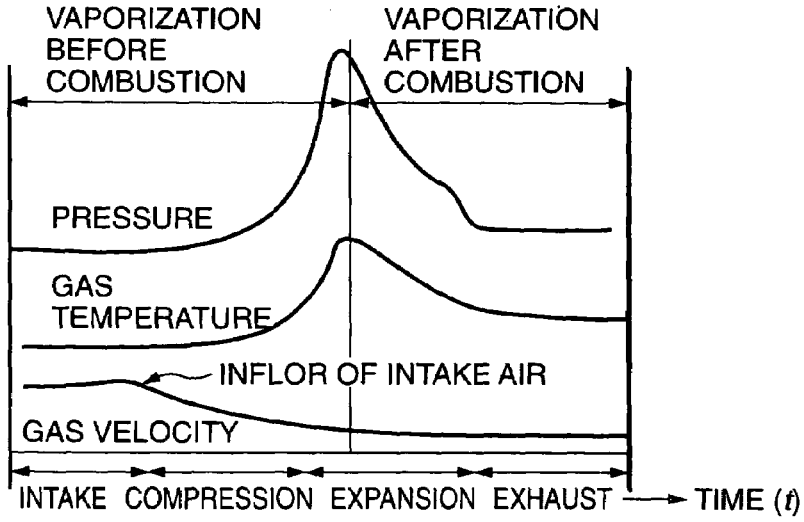

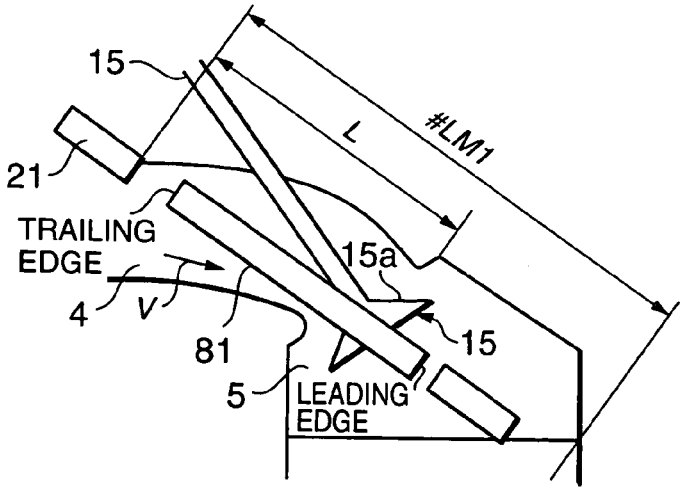
FIG. 36
FIG. 37A
FIG. 37B
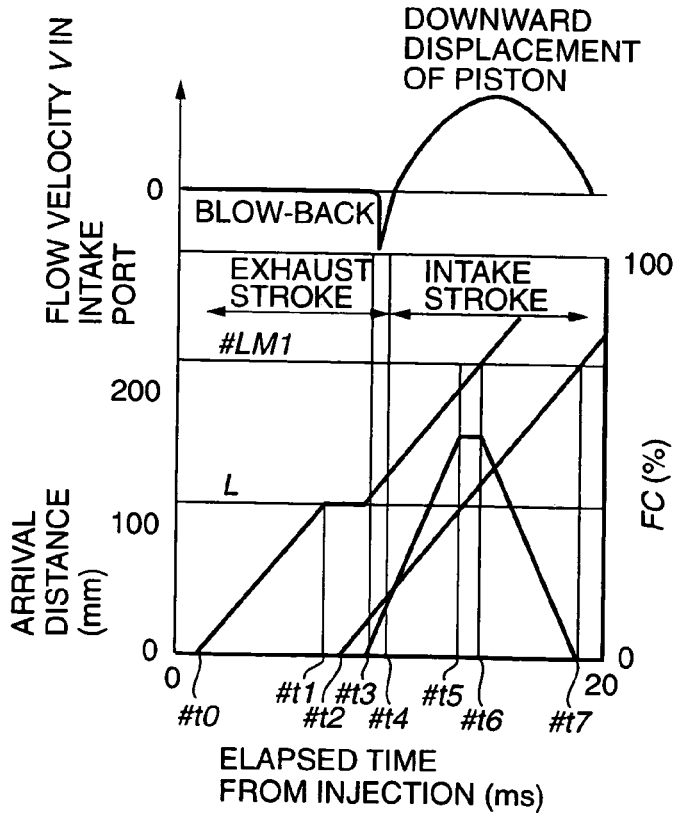

ENGINE FUEL INJECTION AMOUNT CONTROL DEVICE

FIELD OF THE INVENTION

This invention relates to fuel injection control of an internal combustion engine.

BACKGROUND OF THE INVENTION

Tokkai Hei 9-303173 published by the Japan Patent Office in 1998 which concerns fuel injection control of an internal combustion engine, discloses a method of calculating fuel injection amount using a wall flow model. Wall flow means the fuel flow which is formed when some of the fuel injected from the fuel injector adheres to a wall surface of a combustion chamber or an intake port, or to an intake valve. Part of the wall flow vaporizes and burns, and part vaporizes after combustion is complete and is discharged from an exhaust valve without being burnt. The remaining part of the wall flow remains in the combustion chamber until the following combustion cycle.

The ratio of the injected fuel which forms a wall flow is known as an adhesion ratio. Of the fuel forming the wall flow, the ratio of fuel which remains in the combustion chamber in the wall flow state without vaporizing, is known as a residual ratio.

The prior art proposes to construct a behavior model of injected fuel according to the adhesion ratio and residual ratio as parameters. By varying the parameters based on the intake air pressure, the behavior of the fuel supplied to the internal combustion engine is precisely analyzed, thereby enhancing the precision of fuel supply control. Such a behavior model decreases the work amount of the experiments required for adaptation of fuel supply control to respective internal combustion engines and shortens the time required for the development of a new engine.

SUMMARY OF THE INVENTION

According to the prior art, the adhesion ratio and residual ratio are found by experiment. Even if the adhesion ratio and residual ratio are obtained by experiment for a given engine, if it is attempted to apply the same physical model to an engine using a fuel injector having a different specification, the same experiment must be repeated for the adhesion ratio and residual ratio.

It is therefore an object of this invention to represent the distribution of injected fuel by a physical model as closely as possible, and to reduce the matching experiments that are required for a fuel injector of different specification.

In order to achieve the above object, this invention provides a fuel injection control device for such an internal combustion engine that comprises a combustion chamber connected to an intake port via an intake valve. The device comprises a fuel injector provided in the intake port which injects a volatile liquid fuel, and a programmable controller.

The controller is programmed to determine a particle diameter of the fuel injected from the fuel injector, calculate a suspension ratio of the injected fuel in the combustion chamber according to the particle diameter, calculate a burnt fuel amount burnt in the combustion chamber based on the suspension ratio, calculate a target fuel injection amount based on the burnt fuel amount, and control the fuel injection amount of the fuel injector based on the target fuel injection amount.

This invention also provides a fuel injection control method for the same engine. The method comprises determining a particle diameter of the fuel injected from the fuel injector, calculating a suspension ratio of the injected fuel in the combustion chamber according to the particle diameter, calculating a burnt fuel amount burnt in the combustion chamber based on the suspension ratio, calculating a target fuel injection amount based on the burnt fuel amount, and controlling the fuel injection amount of the fuel injector based on the target fuel injection amount.

The details as well as other features and advantages of this invention are set forth in the remainder of the specification and are shown in the accompanying drawings.

BRIEF DESCRIPTION OF THE DRAWINGS

FIG. 30 is a diagram describing the characteristics of an oil mixing ratio basic value.

FIGS. 31A–31C are a timing chart describing variations of pressure, temperature and gas flow velocity during the four-stroke cycle of an internal combustion engine.

FIG. 36 is a schematic longitudinal sectional view of the essential parts of an internal combustion engine describing an injected fuel non-vaporization ratio according to a third embodiment of the invention.

FIGS. 37A and 37B are diagrams describing the characteristics of an injected fuel non-vaporization ratio and intake air flow velocity according to the third embodiment of the invention.

DESCRIPTION OF THE PREFERRED EMBODIMENTS

Figure 1:
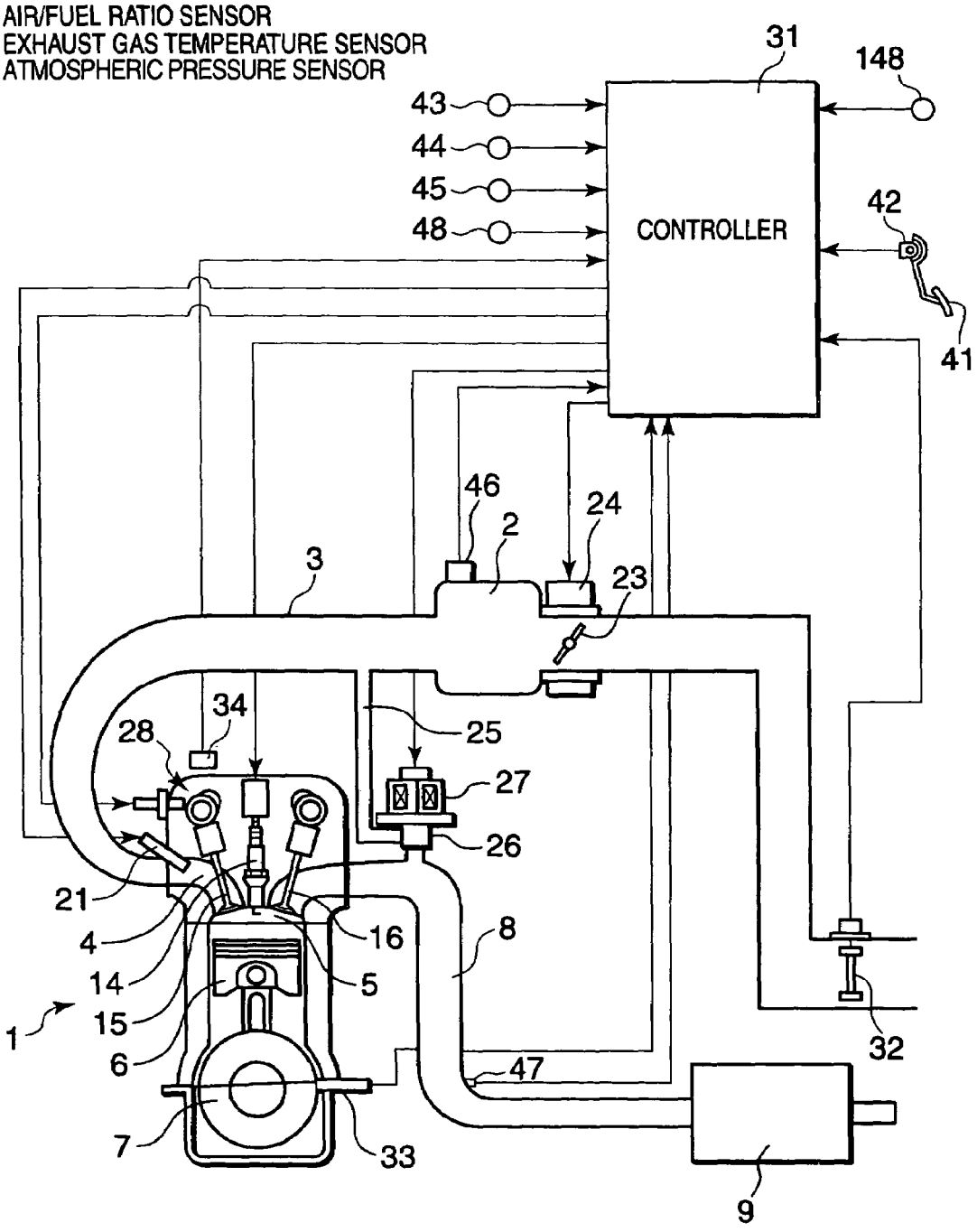
FIG. 1 is a schematic diagram of an internal combustion engine for an automobile to which this invention is applied.

Referring to FIG. 1 of the drawings, a four stroke-cycle internal combustion engine 1 is a multi-cylinder engine for an automobile provided with an L-jetronic type fuel injection device. The engine 1 compresses a gaseous mixture aspirated from an intake passage 3 to a combustion chamber 5 by a piston 6, and ignites the compressed gaseous mixture by a spark plug 14 to burn the gaseous mixture. The pressure of the combustion gas depresses the piston 6 so that a crankshaft 7 connected to the piston 6 rotates. The combustion gas is pushed out from the combustion chamber 5 by the piston 6 which was lifted due to the rotation of the crankshaft 7, and is discharged via an exhaust passage 8.

The piston 6 is housed in a cylinder 50 formed in a cylinder block. In the cylinder block, a water jacket through which a coolant flows is formed surrounding the cylinder 50.

An intake throttle 23 which adjusts the intake air amount and a collector 2 which distributes the intake air among the cylinders, are provided in the intake passage 3. The intake throttle 23 is driven by a throttle motor 24. Intake air distributed by the collector 2 is aspirated into the combustion chamber 5 of each cylinder via an intake valve 15 from an intake port 4. The intake valve 15 functions under a Valve Timing Control (VTC) mechanism 28 which varies the opening/closing timing. However, the variation of the valve opening/closing timing due to the VTC mechanism 28 is such a small variation that it does not affect the setting of a distribution ratio Xn described later.

Combustion gas in the combustion chamber 5 is discharged as exhaust gas to an exhaust passage 8 via an exhaust valve 16. The exhaust passage 8 is provided with a three-way catalytic converter 9. The three -way catalytic converter 9, by reducing nitrogen oxides (NOx) in the exhaust gas and oxidizing hydrocarbons (HC) and carbon monoxide (CO), removes toxic components in the exhaust gas. The three-way catalytic converter 9 has a desirable performance when the exhaust gas composition corresponds to the stoichiometric air-fuel ratio.

A fuel injector 21 which injects gasoline fuel into the intake air is installed in the intake port 4 of each cylinder.

A part of the exhaust gas discharged by the exhaust passage 8 is recirculated to the intake passage 3 via an exhaust gas recirculation (EGR) passage 25. The recirculation amount of the EGR passage 25 is adjusted by an exhaust gas recirculation (EGR) valve 26 driven by a diaphragm actuator 27.

The ignition timing of the spark plug 14, fuel injection amount and fuel injection timing of the fuel injector 21, change of valve timing by the VTC mechanism 28, operation of the throttle motor 24 which drives the intake throttle 23, and operation of the diaphragm actuator 27 which adjusts the opening of the EGR valve 26 are controlled by signals output by an engine controller 31 to the respective instruments.

The engine controller 31 comprises a microcomputer comprising a central processing unit (CPU), read-only memory (ROM), random access memory (RAM) and input/output interface (I/O interface). The engine controller 31 may also comprise plural microcomputers.

To perform the above control, detection results are input as signals to the controller 31 from various sensors which detect the running state of the engine 1.

These sensors include an air flow meter 32 which detects an intake air flow rate of the intake passage 3 upstream of the intake throttle 23, a crank angle sensor 33 which detects a crank angle and a rotation speed of the engine 1, a cam sensor 34 which detects a rotation position of a cam which drives the intake valve 15, an accelerator pedal depression sensor 42 which detects a depression amount of an accelerator pedal 41 with which the automobile is provided, a catalyst temperature sensor 43 which detects a catalyst temperature of the three-way catalytic converter 9, an intake air temperature sensor 44 which detects a temperature of the intake air of the intake passage 3, a water temperature sensor 45 which detects a cooling water temperature Tw of the engine 1, a pressure sensor 46 which detects an intake air pressure in the collector 2, an air-fuel ratio sensor 47 which detects an air-fuel ratio of the air/fuel mixture burnt in the combustion chamber from the exhaust gas composition flowing into the three-way catalytic converter 9, and an exhaust gas temperature sensor 48 which detects an exhaust gas temperature.

The engine controller 31 performs the aforesaid control in order to achieve the required engine output torque specified by the accelerator pedal depression amount, and achieve the exhaust gas composition required by the exhaust gas purification function of the three-way catalytic converter 9, as well as to reduce the fuel consumption.

Specifically, the engine controller 31 determines a target torque of the internal combustion engine 1 according to the accelerator pedal depression amount, determines a target intake air amount required to achieve the target output torque, and adjusts the opening of an intake throttle 23 via the throttle motor 24 so that the target intake air amount is achieved.

On the other hand, the engine controller 31 feedback controls the fuel injection amount of the fuel injector 21 so that the air-fuel ratio of the gaseous mixture burnt in the combustion chamber 5 is maintained within a predetermined range centered on the stoichiometric air-fuel ratio, based on the air-fuel ratio in the combustion chamber 5 detected from the exhaust gas composition by the air-fuel ratio sensor 47. The controller 31 also adjusts an EGR flow rate via the EGR valve 26 and reduces the fuel consumption by adjusting the valve timing of the VTC mechanism 28.

The controller 31 applies combustion prediction control to the control of the fuel injection amount. This control predicts the wall flow and unburnt fuel in the intake port 4 and combustion chamber 5 with temperature as the main parameter, and calculates the fuel injection amount using the result.

Figure 2:
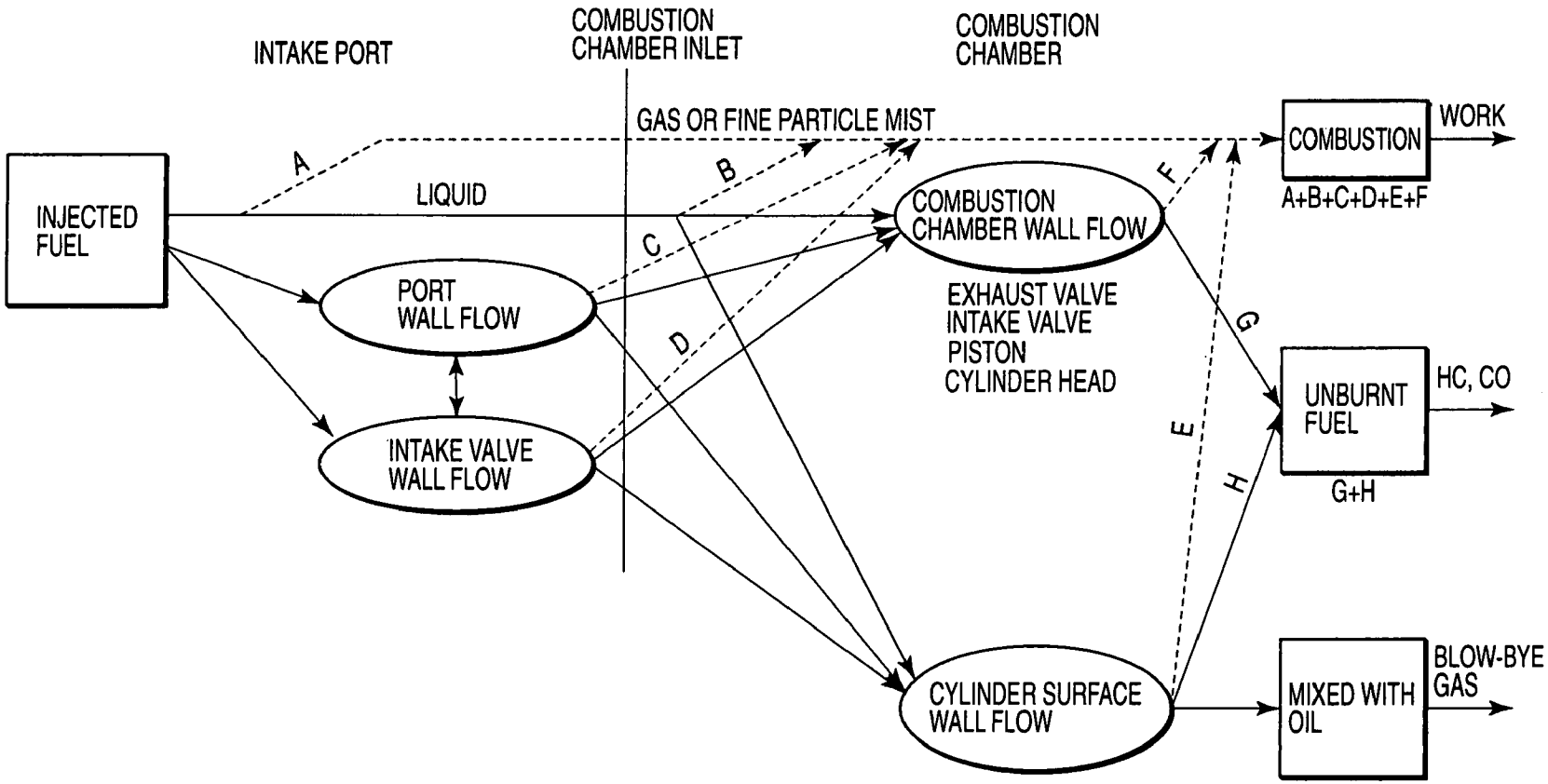
FIG. 2 is a schematic diagram of a fuel behavior model according to this invention.
Figure 3:
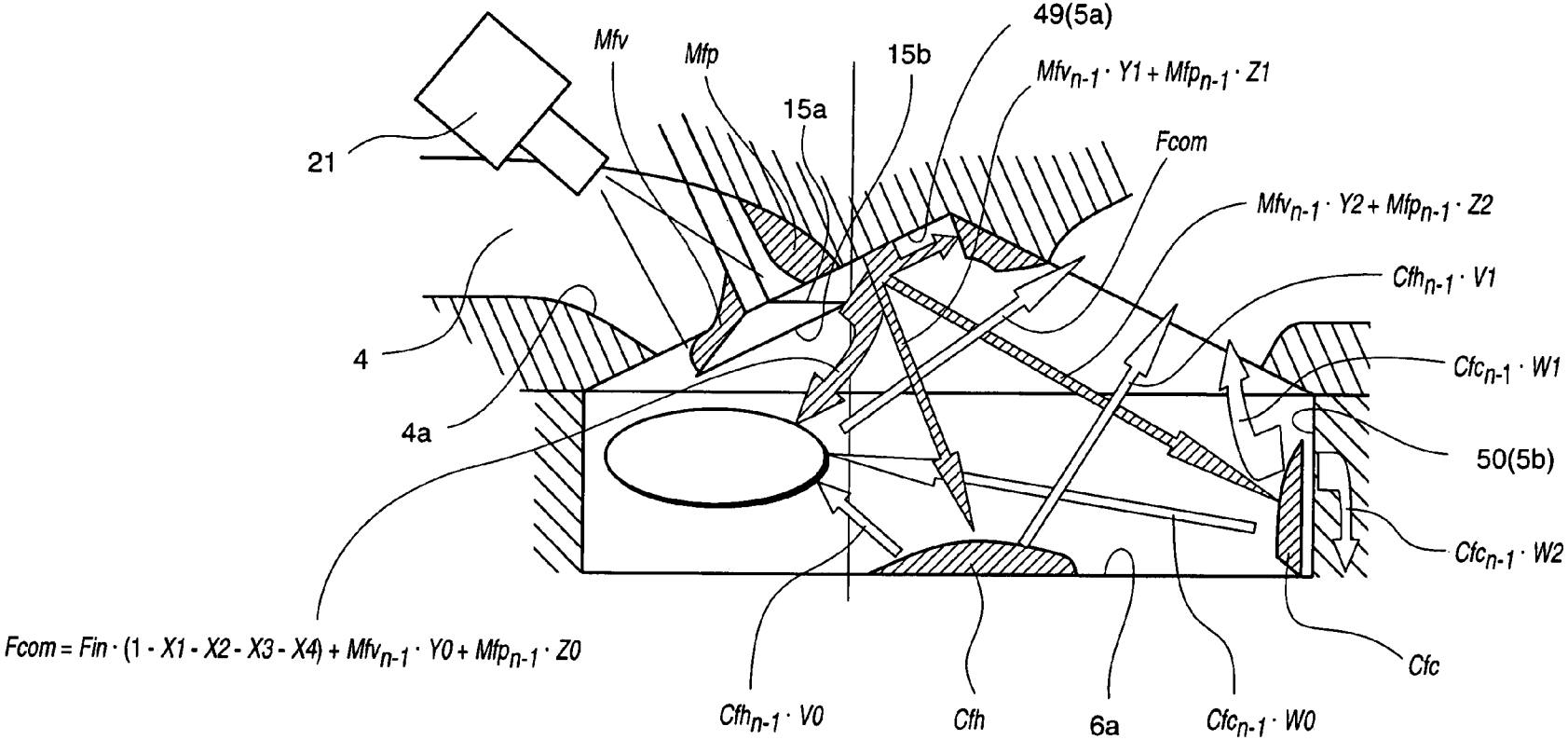
FIG. 3 is a block diagram describing the behavior of injected fuel.

Referring to FIGS. 2 and 3, part of the fuel injected by the fuel injector 21 flows directly into the combustion chamber 5 as a vapor or a mist of fine particles, as shown by the dotted line. Part also flows into the combustion chamber 5 directly or as a wall flow, in the liquid state or as a mist of coarse particles. The mist of fine particles is strictly speaking also liquid, but here it is distinguished from a mist of coarse particles due to its behavior characteristics regardless of whether it is a vapor or a liquid. In other words, the mist of fine particles is treated identically to a vapor which does not adhere to the wall surface of the intake port 4 up to the inlet of the combustion chamber 5, and a behavior inside the combustion chamber 5.

Behavior up to Inlet of Combustion Chamber 5

Part of the fuel injected by the fuel injector 21 flows directly into the combustion chamber 5. The remaining fuel, as shown in FIG. 3, adheres to a wall surface 4*a* of the intake port 4 and the intake valve 15. The fuel adhering to the intake valve 15 may be classified as fuel adhering to a part 15*a* facing the intake port 4 of the valve body, and fuel adhering to a part 15*b* facing the combustion chamber 5. Here, we shall deal with the former, and deal with the latter in the section describing the behavior inside the combustion chamber 5.

For the purpose of this description, fuel adhering to the wall surface 4*a* is referred to as port wall flow, and fuel adhering to the part 15*a* of the intake valve 15 is referred to as valve wall flow.

Part of the port wall flow and part of the valve wall flow respectively detach from the adhesion surface due to evaporation. Alternatively, they separate from the adhesion surface due to the intake air flow or gravity, and become a fine particle mist. This detachment ratio depends on the temperature of the wall surface 4*a* and part 15*a*. The temperatures of the wall surface 4*a* and part 15*a* are identical immediately after startup, but as warm-up proceeds, the temperature of the part 15*a* largely exceeds the temperature of the wall surface 4*a*. Therefore, the detachment ratio of fuel adhering to the wall surface 4*a* and the detachment ratio of fuel adhering to the part 15*a* show different variations depending on the progress of warm-up.

On the other hand, in the port wall flow and valve wall flow, fuel which has not detached from the adhesion surface moves over the adhesion surface as wall flow to enter the combustion chamber 5.

Behavior Inside Combustion Chamber 5

Of the fuel which has reached the combustion chamber (5) by various routes, most is burnt, but some adheres to the wall surface of the combustion chamber 5. The adhesion locations include a part 15*b* of the intake valve 15, the surface of the exhaust valve 16 adjacent to the combustion chamber 5, a wall surface 5*a* of the cylinder head forming the upper end of the combustion chamber 5, a crown 6*a* of the piston 6, a protrusion part of the spark plug 14, and a cylinder wall surface 5*b*.

Part of the wall flow in the combustion chamber 5 vaporizes due to compression heat and the wall surface heat so as to become a gas or a mist of fine particles before the ignition timing, and detaches from the adhesion surface. Part becomes a gas or a mist of fine particles after combustion of the fuel is complete, and is discharged from the exhaust valve 16 to the exhaust passage 8 without being burnt. Further, part of the fuel adhering to the cylinder wall surface 5*b* is diluted by lubricating oil of the engine 1 depending on the stroke of the piston 6, and flows out to a crankcase below the piston 6.

In the following description, the fuel adhesion surface of the combustion chamber 5 is separated into the cylinder wall surface 5*b* and other parts. The separation of the fuel adhesion surface of the combustion chamber 5 into these two parts is because the temperature difference between the two parts is large. As the cylinder wall surface 5*b* is cooled by the cooling water of the water jacket formed in the cylinder block, it maintains a temperature effectively identical to the cooling water temperature Tw.

On the other hand, as regards the other parts, the part 15*b* of the intake valve 15 reaches the highest temperature, and the surface of the exhaust valve 16 facing the combustion chamber 1, and the crown 6*a* of the piston 6 follow. The temperature of the cylinder head wall surface 5*a* is lower than these temperatures, but higher than that of the cylinder wall surface 5*b*.

Due to these reasons, in the following description, among the fuel adhesion surfaces of the combustion chamber 5, the cylinder wall surface 5*b* will be referred to as a combustion chamber low temperature wall surface, and the other adhesion surfaces will be referred to as a combustion chamber high temperature wall surface. The fuel adhesion surfaces of the combustion chamber 5 can also be separated into three or more wall surfaces depending on temperature conditions.

Based on the above analysis, the wall flow formed inside the combustion chamber 5 can be separated into a wall flow formed on the combustion chamber low temperature wall surface, and a wall flow formed on the combustion chamber high temperature wall surface. On the other hand, the fuel in the combustion chamber 5 can be separated into fuel which contributes to combustion, fuel discharged as unburnt fuel, and fuel diluted by engine lubricating oil which flows out to the crankcase.

Referring to FIG. 2, the fuel which contributes to combustion becomes gas or a mist of fine particles present in the combustion chamber 5, and comprises the following components A–F:

A: Gas or a mist of fine particles produced immediately after fuel injection by the fuel injector 21, B: Fuel which flows into the combustion chamber 5 as a mist of coarse particles, and becomes gas or a mist of fine particles in the combustion chamber 5, C: Gas or a mist of fine particles produced from part of the port wall flow, D: Gas or a mist of fine particles produced from part of the valve wall flow, E: Gas or a mist of fine particles produced from part of the wall flow on the combustion chamber low temperature wall surface, and F: Gas or mist of fine particles produced from part of the wall flow on the combustion chamber high temperature wall surface.

The fuel discharged as unburnt fuel is also gas or a mist of fine particles present in the combustion -chamber 5, and comprises the following components G and H:

G: Gas or a mist of fine particles produced from part of the wall flow on the combustion chamber high temperature wall surface after combustion is complete, and H: Gas or a mist of fine particles produced from part of the wall flow on the combustion chamber low temperature wall surface after combustion is complete.

The fuel flowing out to the crankcase comprises the following component I.

I: Fuel comprising part of the wall flow of the combustion chamber low temperature wall surface, which is diluted by engine lubricating oil.

Therefore, the wall flow formed by the fuel injection of the fuel injector 21 comprises four adhesion fuels, i.e., intake port adhesion fuel, intake valve adhesion fuel, combustion chamber low temperature wall surface adhesion fuel and combustion chamber high temperature wall surface adhesion fuel. The combustion prediction control applied by the controller 31 to control of the fuel injection amount, is based on an air-fuel mixture model per cylinder designed according to this classification.

Figure 4:
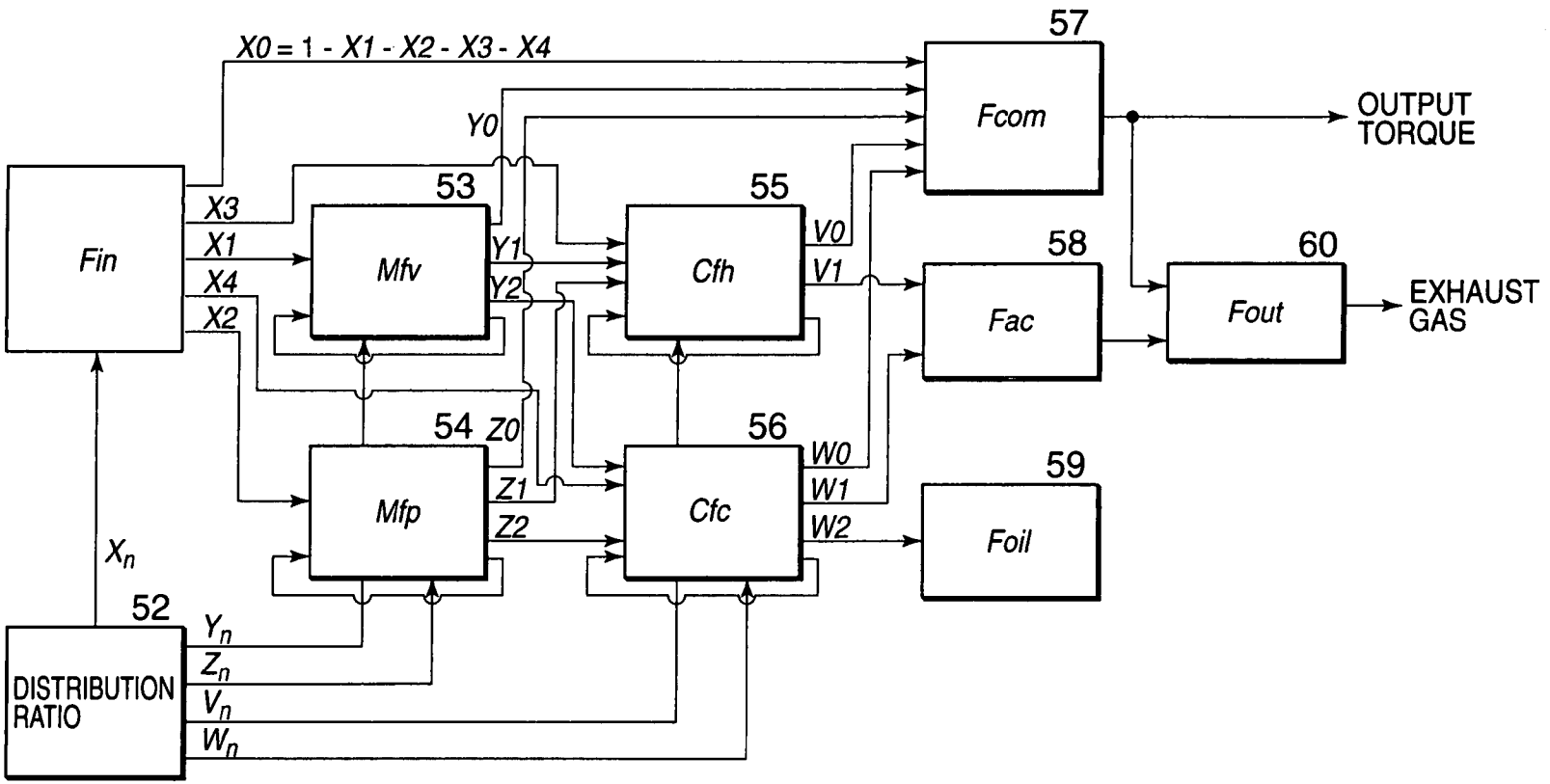
FIG. 4 is a block diagram describing a fuel behavior analysis function of an engine controller according to this invention.

Referring to FIG. 4, to perform the fuel behavior analysis based on this air-fuel mixture model, the controller 31 comprises a fuel distribution ratio calculating unit 52, intake valve adhesion amount calculating unit 53, intake port adhesion amount calculating unit 54, combustion chamber high temperature wall surface adhesion amount calculating unit 55, combustion chamber low temperature wall surface adhesion amount calculating unit 56, combustion fraction calculating unit 57, unburnt fraction calculating unit 58, crankcase outflow fraction calculating unit 59, and discharged fuel calculating unit 60. The controller 31 performs a fuel behavior analysis by these units 52–60 each time the fuel injector 21 injects fuel.

These units 52–60 show the functions of the controller 31 as virtual units, and do not exist physically.

Summarizing the fuel behavior analysis functions, the controller 31 quantitatively analyzes the aforesaid components A–I relative to the fuel injection amount Fin injected by the fuel injector 21, and calculates a burnt fuel amount Fcom, fuel amount Fout corresponding to the exhaust gas composition, and fuel amount Foil flowing out to the crankcase. The burnt fuel amount Fcom corresponds to the components A–F. The fuel amount Fout corresponding to the exhaust gas composition is the sum of the components A–F and the components G and H which are the unburnt fuel amount. The fuel amount Foil flowing out to the crankcase corresponds to the component 1.

Next, the functions of these units will be described.

The fuel distribution ratio calculating unit 52 determines how to progressively divide the fuel injection amount Fin between each part. The distribution ratio Xn shows the distribution ratio of the fuel injection amount Fin. The distribution ratio Yn shows the subsequent distribution ratio of fuel which has adhered to the intake valve 15. The distribution ratio Zn shows the subsequent distribution ratio of fuel which has adhered to the wall surface 4*a* of the intake port 4. The distribution ratio Vn shows the subsequent distribution ratio of fuel which has adhered to the combustion chamber high temperature wall surface. The distribution ratio Wn shows the subsequent distribution ratio of fuel which has adhered to the combustion chamber low temperature wall surface. The method of calculating the distribution ratios Xn, Yn, Zn, Vn, Wn will be described later.

Herein, the distribution ratios Xn, Yn, Zn, Vn, Wn will respectively be described as known values. The situation will be described assuming that the fuel injector 21 has just injected fuel. This injection amount will be taken as Fin. Therefore, the fuel injection amount Fin is a value known by the controller 31.

The intake valve adhesion amount calculating unit 53 calculates an intake valve adhesion amount Mfv by the following equation (1) from the fuel injection amount Fin and the distribution ratios Xn, Yn, Zn. Likewise, the intake port adhesion amount calculating unit 54 calculates an intake port adhesion amount Mfp by the following equation (2).

$$Mfv=Mfv_{n-1}+Fin\cdot X1-Mfv_{n-1}\cdot(Y0+Y1+Y2) \quad (1)$$

$$Mfp=Mfp_{n-1}+Fin\cdot X2-Mfp_{n-1}\cdot(Z0+Z1+Z2) \quad (2)$$

where, Mfv=intake valve adhesion amount, $Mfv_{n-1}$=value of Mfv in immediately preceding combustion cycle, Mfp=intake port adhesion amount, $Mfp_{n-1}$=value of Mfp in immediately preceding combustion cycle, Fin=fuel injection amount, X1=adhesion ratio of injected fuel to intake valve, X2=adhesion ratio of injected fuel to intake port, Y0=ratio of fuel relative to $Mfv_{n-1}$ which became gas or mist of fine particles and entered combustion chamber 5 prior to present injection, Y1=ratio of fuel relative to $Mfv_{n-1}$ which became combustion chamber low temperature wall flow prior to present injection, Y2=ratio of fuel relative to $Mfv_{n-1}$ which became combustion chamber high temperature wall flow prior to present injection, Z0=ratio of fuel relative to $Mfp_{n-1}$ which became gas or mist of fine particles and entered combustion chamber 5 prior to present injection, Z1=ratio of fuel relative to $Mfp_{n-1}$ which became combustion chamber low temperature wall flow prior to present injection, and Z2=ratio of fuel with respect to $Mfp_{n-1}$ which became combustion chamber high temperature wall flow prior to present injection.

In equation (1), an adhesion amount Fin·X1 due to the present fuel injection is first added to the intake valve adhesion amount $Mfv_{n-1}$ in the immediately preceding combustion cycle, and part of the intake valve adhesion amount $Mfv_{n-1}$ in the immediately preceding combustion cycle, i.e., a fuel amount $Mfv_{n-1}\cdot(Y0+Y1+Y2)$ which flowed into the combustion chamber 5 prior to the present fuel injection, is subtracted from the result.

In equation (2), an adhesion amount Fin·X2 due to the present fuel injection is first added to the intake port adhesion amount $Mfp_{n-1}$ in the immediately preceding combustion cycle, and part of the intake port adhesion amount $Mfp_{n-1}$ in the immediately preceding combustion cycle, i.e., a fuel amount $Mfp_{n-1}\cdot(Z0+Z1+Z2)$ which flowed into the combustion chamber 5 prior to the present fuel injection, is subtracted from the result.

The combustion chamber high temperature wall surface adhesion amount calculating unit 55 calculates a combustion chamber high temperature wall surface adhesion amount Cfh by the following equation (3) from the fuel injection amount Fin, the distribution ratios Xn, Yn, Vn, Wn, and the intake valve adhesion amount $Mfv_{n-1}$ and intake port adhesion amount $Mfp_{n-1}$ in the immediately preceding combustion cycle.

$$Cfh=Cfh_{n-1}+Fin\cdot X3+Mfv_{n-1}\cdot Y1+Mfp_{n-1}\cdot Z1-Cfh_{n-1}\cdot(V0+V1) \quad (3)$$

Likewise, the combustion chamber low temperature wall surface adhesion amount calculating unit 56 calculates a combustion chamber low temperature wall surface adhesion amount Cfc by the following equation (4):

$$Cfc=Cfc_{n-1}+Fin\cdot X4+Mfv_{n-1}\cdot Y2+Mfp_{n-1}\cdot Z2-Cfc_{n-1}\cdot(W0+W1+W2) \quad (4)$$

where, Cfh=combustion chamber high temperature wall surface adhesion amount, $Cfh_{n-1}$=value of Cfh in immediately preceding combustion cycle, Cfc=combustion chamber low temperature wall surface adhesion amount.

$Cfc_{n-1}$=value of Cfc in immediately preceding combustion cycle,

X3=adhesion ratio of injected fuel to combustion chamber low temperature wall surface, X4=adhesion ratio of injected fuel to combustion chamber high temperature wall surface, V0=ratio of fuel relative to $Cfh_{n-1}$ which burnt prior to present injection, V1=ratio of fuel relative to $Cfh_{n-1}$ which was discharged as unburnt fuel prior to present injection, W0=ratio of fuel relative to $Cfc_{n-1}$ which burnt prior to present injection, W1=ratio of fuel relative to $Cfc_{n-1}$ which was discharged as unburnt fuel prior to present injection, and W2=ratio of fuel relative to $Cfc_{n-1}$ which flowed out to crankcase prior to present injection.

In equation (3), a fuel amount Fin·X4 due to the present fuel injection is first added to the combustion chamber high temperature wall surface adhesion amount $Cfh_{n-1}$ in the immediately preceding combustion cycle, and part of the combustion chamber high temperature wall surface adhesion amount $Cfh_{n-1}$ in the immediately preceding combustion cycle, i.e., a fuel amount $Cfh_{n-1}\cdot(V0+V1)$ discharged to the outside prior to the present fuel injection, is subtracted from the result.

In equation (4), a fuel amount Fin·X3 due to the present fuel injection is first added to the combustion chamber low temperature wall surface adhesion amount $Cfc_{n-1}$ in the immediately preceding combustion cycle, and part of the combustion chamber low temperature wall surface adhesion amount $Cfc_{n-1}$ in the immediately preceding combustion cycle, i.e., a fuel amount $Cfc_{n-1}\cdot(W0+W1+W2)$ discharged to the outside prior to the present fuel injection, is subtracted from the result.

It should be noted that FIGS. 2–4 show the fuel behavior model for calculating the real fuel amount injected by the controller 31, but the fuel behavior model is the combination of separate fuel behavior models, i.e., an intake valve wall flow model expressed by equation (1), an intake port wall flow model expressed by equation (2), a combustion chamber high temperature wall surface wall flow model expressed by equation (3), and a combustion chamber low temperature wall surface wall flow model expressed by equation (4).

A combustion fraction calculating unit 57 calculates the burnt fuel amount Fcom by the following equation (5):

$$Fcom=Fin\cdot(1-X1-X2-X3-X4)+Mfv_{n-1}\cdot Y0+Mfp_{n-1}\cdot Z0+Cfh_{n-1}\cdot V0+CfC_{n-1}\cdot W0 \quad (5)$$

The burnt fuel amount Fcom obtained by equation (5) corresponds to the sum value of the aforesaid components A–F. 1−X1−X2−X3−X4 in equation (5) corresponds to the ratio X0 of the component A.

The unburnt fraction calculating unit 58 calculates the fuel amount Fac discharged as unburnt fuel.

$$Fac=Cfh_{n-1}\cdot V1+Cfc_{n-1}\cdot W1 \quad (6)$$

The fuel amount Fac discharged as unburnt fuel obtained by equation (6) corresponds to the sum value of the aforesaid components G and H.

The crankcase outflow fraction calculating unit 59 calculates the fuel amount Foil flowing out to the crankcase by the following equation (7):

$$Foil=Cfc_{n-1}\cdot W2 \quad (7)$$

The fuel amount Foil flowing out of the crankcase obtained by equation (7) corresponds to the aforesaid component I.

The discharged fuel calculating unit 60 calculates the fuel amount Fout which forms an exhaust gas component by the following equation (8):

$$Fout=Fcom+Fac \quad (8)$$

The fuel amount Fout obtained by equation (8) is the sum of the burnt fuel amount Fcom and the fuel amount Fac discharged as unburnt fuel In other words, the fuel amount Fout is the sum total of the fuel flowing out to the exhaust passage 8. Part of the gas in the combustion chamber 5 remains in the combustion chamber 5 without being discharged, but considering that it cancels out the gas remaining in the preceding combustion cycle, the remaining fraction is not considered in equation (8).

The fuel amounts calculated in the aforesaid equations (1)–(8) are shown graphically in FIG. 3.

Figure 5:
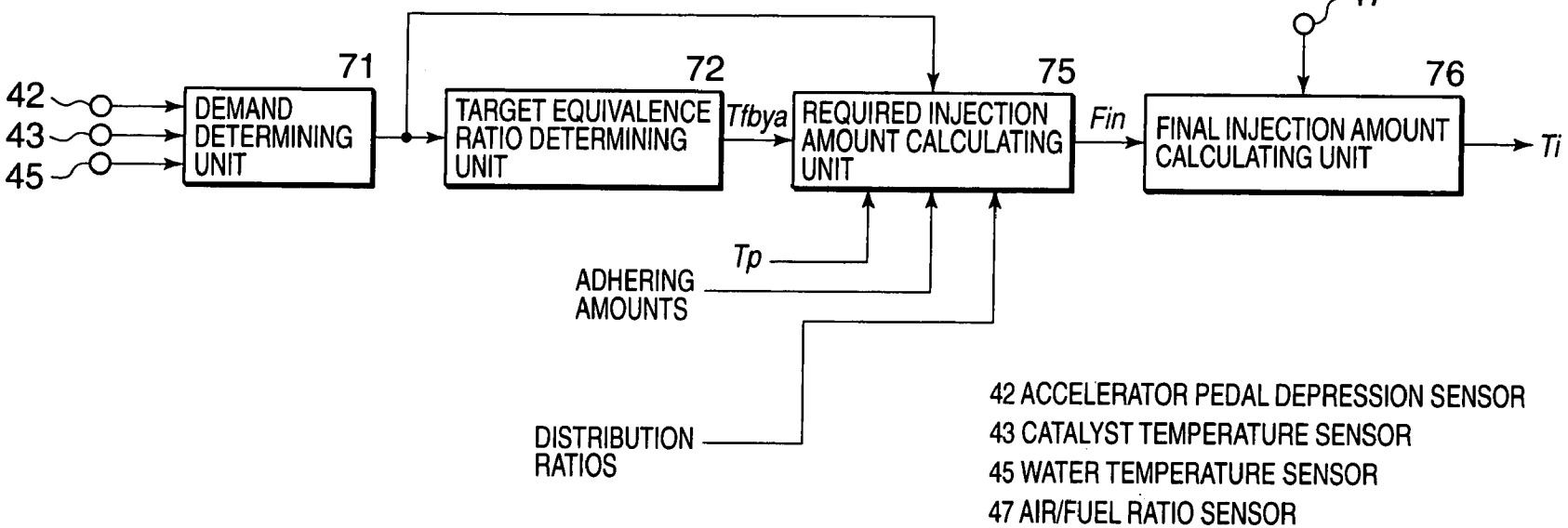
FIG. 5 is a block diagram describing a fuel injection amount calculation function of the engine controller.

The controller 31 feedback controls the fuel injected by the fuel injector 21 according to the construction shown in FIG. 5 using the aforesaid fuel behavior analysis results.

Referring to FIG. 5, in addition to the units 52–60 shown in FIG. 4, the controller 31 further comprises a demand determining unit 71, a target equivalence ratio determining unit 72, a required injection amount calculating unit 75 and final injection amount calculating unit 76. These units 71, 72, 75, 76 represent the functions of the controller 31 as virtual units, and do not exist physically.

Referring to FIG. 5, concerning the equivalence ratio of the fuel-air mixture, the demand determining unit 71 determines whether or not there is a demand regarding exhaust gas composition, whether or not there is a demand regarding engine output power, and whether or not there is a demand regarding engine running stability.

The equivalence ratio is a value obtained by dividing the stoichiometric air-fuel ratio by the air-fuel ratio. The stoichiometric air-fuel ratio is 14.7, and when the air-fuel ratio is identical to the stoichiometric air-fuel ratio, the equivalence ratio is 1.0. When the equivalent ratio is more than 1.0, the air -fuel ratio is rich, and when the equivalence ratio is less than 1.0, the air-fuel ratio is lean.

A demand regarding exhaust gas composition is output when the three-way catalyst of the three-way catalytic converter 9 is activated. Specifically, it is output when the detection temperature of the catalyst temperature sensor 43 reaches the catalyst activation temperature. When the three-way catalyst is activated, the exhaust gas composition corresponding to the stoichiometric air-fuel ratio is required in order for the three-way catalyst to satisfy its functions of reducing nitrogen oxides and oxidizing carbon monoxide and hydrocarbons.

A demand regarding engine output power is output in order to increase the engine output power. Specifically, when the depression amount of the accelerator pedal 41 detected by the accelerator pedal depression sensor 42 exceeds a predetermined amount, it is determined that there is a demand for engine output power.

A demand regarding engine running stability is output when the engine 1 starts at low temperature, within a predetermined time from startup. Specifically, when the water temperature on engine startup detected by the water temperature sensor 45 is less than a predetermined temperature, a demand regarding engine running stability is output from startup of the engine 1 for a predetermined warm-up time period.

The demand determining unit 71 determines the aforesaid three demands. The measurement of the elapsed time from startup of the engine 1 is performed using the clock function of the microcomputer forming the controller 31.

The target equivalence ratio determining unit 72 determines the target equivalence ratio of the air-fuel mixture supplied to the combustion chamber 5 of the engine I according to the demand determined by the demand determining unit 71. Specifically, when there is a demand for engine output power or a demand for engine running stability, a target equivalence ratio Tfbya is set to a value from 1.1 to 1.2. When there is a demand for exhaust gas composition, the target equivalence ratio Tfbya is set to 1.0 corresponding to the stoichiometric air-fuel ratio A demand for engine output power or a demand for engine running stability has priority over a demand for exhaust gas composition. Also, when there are no demands, the target equivalence ratio Tfbya is set to 1.0 corresponding to the stoichiometric air-fuel ratio. In other words, as long as there is no demand for engine output power or demand for engine running stability, the target equivalence ratio determining unit 72 sets the target equivalent ratio Tfbya to 1.0.

The required injected fuel calculating unit 75 calculates the required injection amount Fin based on the target equivalence ratio Tfbya, the demand determined by the demand determining unit 71, the fuel distribution ratio set by the fuel distribution ratio calculating unit 52, and the adhesion amounts $Mfv_{n-1}$, $Mfp_{n-1}$, $Cfh_{n-1}$, $Cfc_{n-1}$, calculated by the adhesion amount calculating units 53–36 by the following process.

The fuel amount Fcom burnt in the combustion chamber 5 is given by the aforesaid equation (5). This can be rewritten as the following equation (9):

$$\begin{aligned} Fcom &= Fin \cdot X0 + Mfv_{n-1} \cdot Y0 + Mfp_{n-1} \cdot Z0 + \\ &\quad Cfh_{n-1} \cdot V0 + Cfc_{n-1} \cdot W0 \\ &= K\# \cdot Tfbya \cdot Tp \end{aligned} \tag{9}$$

where, K#=constant for unit conversion,

Tp=basic fuel injection amount=

$$\frac{Qs}{Ne} \cdot K,$$

Qs=intake air flow rate detected by the air flow meter 32,

Ne=engine rotation speed detected by the crank angle sensor 33, and

K=constant.

The calculation of the basic fuel injection amount Tp is known from U.S. Pat. No. 5,529,043.

The required injection amount calculating unit 75, when there is a demand for engine output power or a demand for engine running stability, sets the ratio of the burnt fuel amount Fcom and cylinder intake air amount Qcyl to be richer than the stoichiometric air-fuel ratio, i.e., sets the target equivalence ratio Tfbya in equation (9) to a predetermined value from 1.1 to 1.2, and calculates the required injection amount Fin by equation (10):

$$Fin = \frac{K\# \cdot Tfbya \cdot Tp - (Mfv_{n-1} \cdot Y0 + Mfp_{n-1} \cdot Z0 + Cfh_{n-1} \cdot V0 + Cfv_{n-1} \cdot W0)}{X0} \tag{10}$$

When there is no demand for engine output power or engine running stability, the required injection amount Fin is calculated by the following equation (11) with the target equivalent ratio Tfbya as 1.0.

$$\begin{aligned} Fin = \{&K\# \cdot Tfbya \cdot Tp - (Mfv_{n-1} \cdot Y0 + Mfp_{n-1} \cdot Z0 + \\ &Cfh_{n-1} \cdot V0 + Cfc_{n-1} \cdot W0 + Cfh_{n-1} \cdot V1 + \\ &Cfc_{n-1} \cdot W1)\} \cdot \frac{1}{X0} \end{aligned} \tag{11}$$

Equation (11) includes $Cfh_{n-1} \cdot V1 + Cfc_{n-1} \cdot W1$ which was not added in equation (10) in the calculation of the required injection amount Fin. This corresponds to the components G and H discharged from the exhaust valve 16 as unburnt fuel. In most cases when there is no demand for engine output power or engine running stability, there is a demand for exhaust gas composition. Here, it is not the air-fuel ratio of the burnt air -fuel mixture which directly affects the action of the three-way catalyst, but the exhaust gas composition. Therefore, in equation (11), the unburnt gas $Cfh_{n-1} \cdot V1 + Cfc_{n-1} \cdot W1$ is taken into account to determine the required injection amount Fin. On the other hand, the unburnt fuel gas does not contribute to combustion, and is not taken into account in equation (10).

The basic fuel injection amount Tp of equation (9) is a value expressing the fuel injection amount per cylinder in terms of mass. Also, all of Fin, $Mfv_{n-1}$, $Mfp_{n-1}$, $Cfh_{n-1}$ and $Cfc_{n-1}$ on the right-hand side of equation (9) are masses per cylinder. The fuel injection signal which the controller 31 outputs to the fuel injector 21 is a pulse width modulation signal, and its units are not milligrams which are mass units but milliseconds which show pulse width. If Fin, $Mfv_{n-1}$, $Mfp_{n-1}$, $Cfh_{n-1}$ and $Cfc_{n-1}$ on the right-hand side of equation (9) are expressed in milliseconds, the constant K# is 1.0.

The final injection amount calculating unit 76 calculates a final injection amount Ti using the following equation (12a) or (12b) based on the required injection amount Fin calculated by the required injection amount calculating unit 75. Here, the units of Fin and Ti are also milliseconds.

$$Ti=Fin\cdot\alpha\cdot\alpha m\cdot 2+Ts \quad (12a)$$

$$Ti=Fin\cdot(\alpha+\alpha m-1)+Ts \quad (12b)$$

where, $\alpha$=air-fuel ratio feedback correction coefficient, $\alpha m$=air-fuel ratio learning correction coefficient, and Ts=ineffectual pulse width.

Here, the air-fuel ratio feedback correction coefficient a is set by having the controller 31 compare the air-fuel ratio corresponding to the target equivalence ratio Tfbya with the real air-fuel ratio detected by the air-fuel ratio sensor 47, and performing proportional/integral control according to the difference. The change of air-fuel ratio feedback correction coefficient a is also learned, and the air-fuel ratio learning correction coefficient $\alpha m$ is determined. The control of air-fuel ratio by such feedback and learning is known from U.S. Pat. No. 5,529,043.

The controller 31 outputs a pulse width modulation signal corresponding to a target fuel injection amount Ti to a fuel injector 21.

The fuel injection amount Fin calculated by the required injection amount calculating unit 75, is used as a fuel injection amount by fuel behavior analysis in a next combustion cycle, as shown in FIG. 4. In this way, the fuel injection amount supplied by the fuel injector 21 is controlled for each combustion cycle.

The required injection amount calculating unit 75 selectively applies equation (10) or (11) to the calculation of the required fuel injection amount Fin based on the demand determined by the demand determining unit 71.

Therefore, when the determination result of the demand determining unit 71 changes over, the fuel injection amount Fin varies in a stepwise fashion, and as a result, the engine output varies in a stepwise fashion and a torque shock may occur.

To prevent torque shock accompanying demand variations, the demand determining unit 71 may also preferably calculate a demand ratio according to a demand status, and calculate the required fuel injection amount Fin by performing an interpolation calculation between the values calculated by the required injection amount calculating unit 75 from equation (10) and equation (11).

The demand status is determined as follows.

Figure 6:
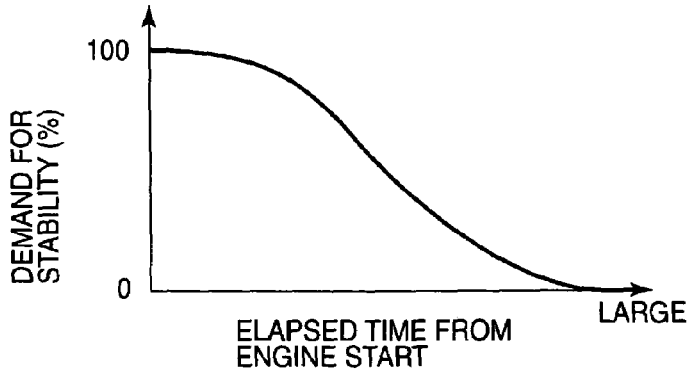
FIG. 6 is a diagram describing the characteristics of a demand and degree map of an engine running stability stored by the controller.

Referring to FIG. 6, in this embodiment, it is assumed that when the elapsed time after engine startup is zero, the demand degree of engine running stability is 100%, and that this demand degree of engine running stability decreases with elapsed time.

Figure 7:
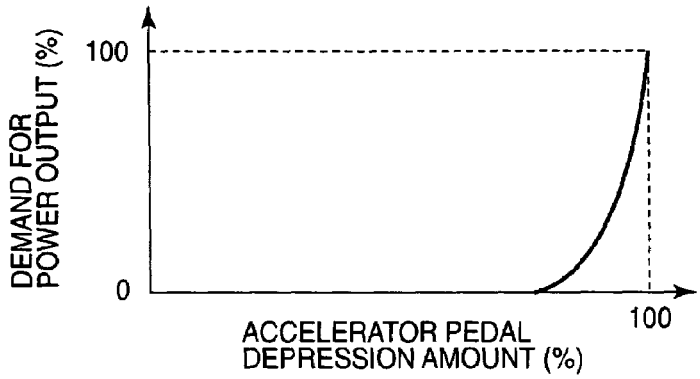
FIG. 7 is a diagram describing the characteristics of a demand degree map of an engine output stored by the controller.

Referring to FIG. 7, in this embodiment, it is assumed that until an accelerator pedal depression amount exceeds a predetermined amount, the demand degree of engine output is zero, and that the demand degree of engine output increases from zero to 100% as the accelerator pedal depression amount increases from the predetermined amount to a maximum value.

Figure 8:
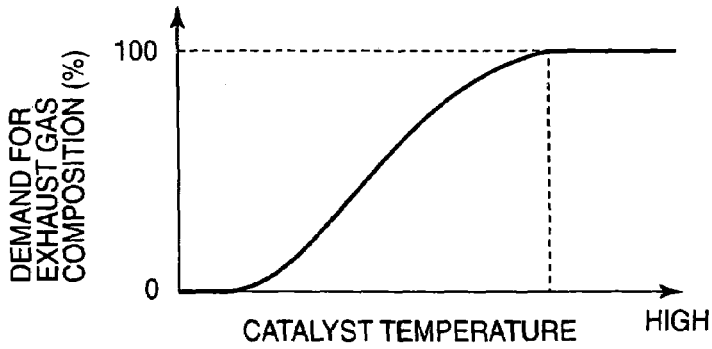
FIG. 8 is a diagram describing the characteristics of a demand degree map of an engine exhaust gas composition stored by the controller.

Referring to FIG. 8, in this embodiment, it is assumed that when the catalyst temperature of a three-way catalytic converter 9 is equal to or higher than an activation temperature, the demand degree of exhaust gas composition is 100%, that immediately after engine startup, the demand degree of exhaust gas composition is zero, and that it increases from zero to 100% as the catalyst temperature increases.

Demand degree maps having the characteristics shown in FIGS. 6–8 are pre-stored in the memory (ROM) of the controller 31.

The demand determining unit 71 looks up a map corresponding to FIG. 6 from the elapsed time after startup of the engine 1, and determines the demand degree of engine running stability. The demand determining unit 71 looks up a map corresponding to FIG. 7 from the accelerator pedal depression amount detected by the accelerator pedal depression sensor 42, and determines the demand degree of engine output. The demand determining unit 71 looks up a map corresponding to FIG. 8 from the temperature detected by the catalyst temperature sensor 43, and determines the demand degree of exhaust gas composition.

The required injection amount calculating unit 75 selects the largest value of the three types of demand degree calculated by the demand determining unit 71. At the same time, a calculation result Fin1 of equation (10) and a calculation result Fin2 of equation (11) are obtained by performing the calculations of equations (10) and (11). The required injection amount calculating unit 75 calculates the fuel amount Fin by performing an interpolation calculation by the following equation (13) from these calculation results and demand degrees.

$$Fin=Fin2\cdot(\text{requirement degree}/100)+Fin1(1-\text{requirement degree}/100) \quad (13)$$

By applying an interpolation calculation depending on the demand degree to the calculation of the fuel injection amount Fin in this way, the fuel injection amount does not vary sharply when there is a change-over of demand, and torque shock is prevented.

Next, the methods of calculating distribution ratios Xn, Yn, Zn, Vn, Wn calculated by the fuel distribution ratio calculating unit 52 will be described separately.

This embodiment can be applied to any L-Jetronic fuel injection system of gasoline injection engine having an intake throttle in the intake passage and not having a VTC mechanism in the intake valve.

However, it may be applied to a VTC mechanism when the valve timing variation amount is small, as in the case of a VTC mechanism 28. On the other hand, it cannot be applied for example to an engine which does not have an intake throttle and adjusts the intake air amount by means of a special intake valve, to an engine having an electromagnetic drive type intake valve, or an engine having a variable compression ratio.

Figure 9:
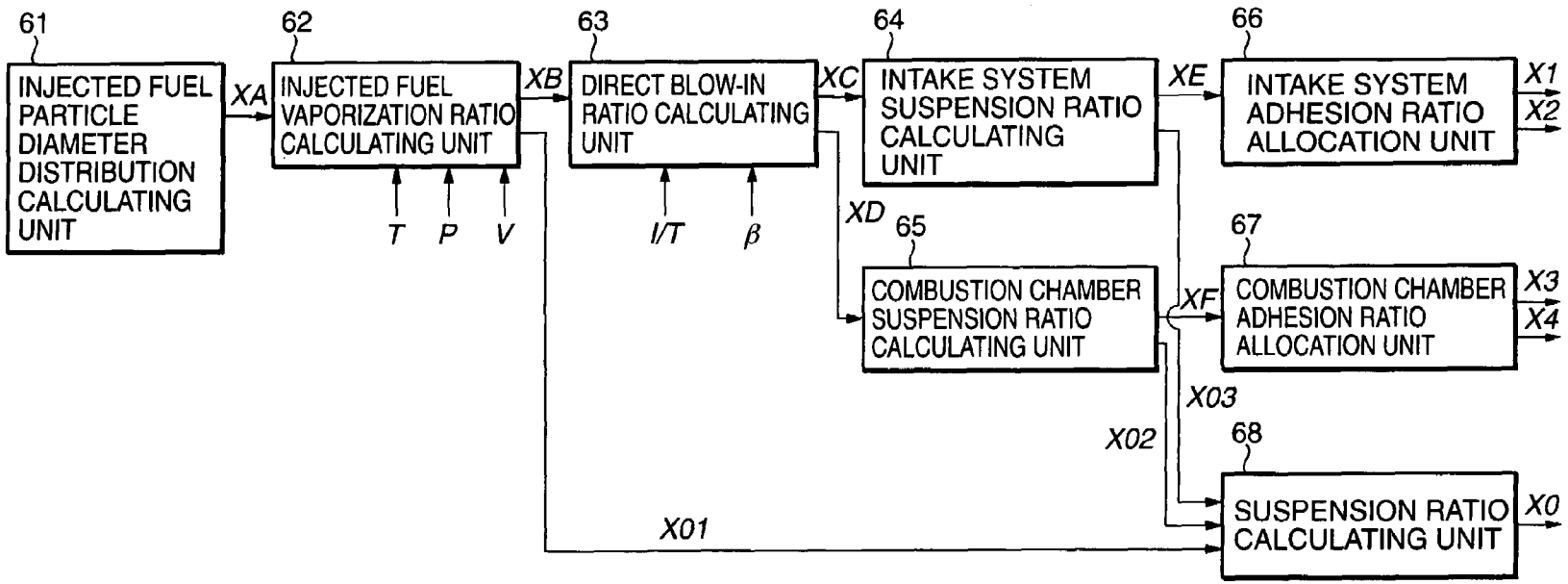
FIG. 9 is a block diagram describing an injected fuel behavior analyzing function of the controller.

Referring to FIG. 9, the fuel distribution ratio calculating unit 52 comprises units 61–68 for performing behavior analysis of the fuel injected by the fuel injector 21. Specifically, these are the injected fuel particle diameter distribution calculating unit 61, injected fuel vaporization ratio calculating unit 62, direct blow-in ratio calculating unit 63, intake system suspension ratio calculating unit 64, combustion chamber suspension ratio calculating unit 65, intake system adhesion ratio allocation unit 66, combustion chamber adhesion ratio allocation unit 67 and suspension ratio calculating unit 68. These units 61–68 represent the functions of the fuel distribution ratio calculating unit 52 as virtual units, and do not exist physically.

First, a brief description of the functions of the units 61–68 will be given, followed by a detailed description of the methods of calculating the values calculated by these units.

The injected fuel particle diameter distribution calculating unit 61 calculates the particle diameter distribution of the injected fuel. The particle diameter distribution of the injected fuel represents the mass ratio of the injected fuel in each particle diameter region in terms of a matrix. A map of this particle diameter distribution is pre-stored in the ROM of the controller 31. The calculation of the injected fuel particle diameter performed by the injected fuel particle diameter distribution calculating unit 61 therefore implies that a mass ratio matrix for each injected fuel particle diameter is read out from the ROM of the controller 31.

The injected fuel vaporization ratio calculating unit 62 calculates the vaporization ratio of the injected fuel in each particle diameter region from a temperature T, pressure P and flow velocity V of an intake port 4. A ratio X01 (%) of vaporized fuel in the injected fuel is then computed by integrating the vaporization ratio for all particle diameter regions. All the vaporized fuel flows into the combustion chamber 5. On the other hand, the ratio of fuel which Is not vaporized is XB=100−X01. In other words, a fuel amount XB (%) in the injected fuel is not vaporized. The injected fuel vaporization ratio calculating unit 62 outputs the distribution ratio X01 of the vaporized fuel to the suspension ratio calculating unit 68 and outputs the distribution ratio XB of the non-vaporized fuel to the direct blow-in ratio calculating unit 63.

Figure 15:
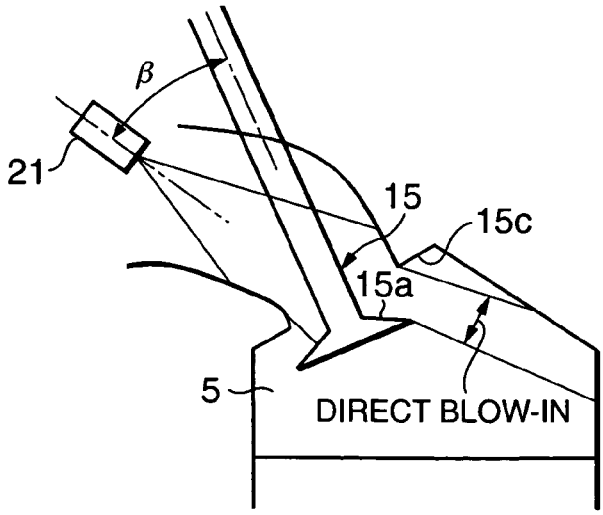
FIG. 15 is a schematic longitudinal sectional view of an engine describing inflow of injected fuel to a combustion chamber.

The direct blow-in ratio calculating unit 63 calculates a ratio XD (%) of the injected fuel which is directly blown into the combustion chamber 5 without vaporizing and without striking the intake valve 15 or intake air port 4 from a fuel injection timing I/T, and an angle β subtended by the fuel injector 21 and intake valve 15 shown in FIG. 15. A ratio XC(%) of injected fuel remaining in the intake air port 4 is also calculated by the calculation equation XC=XB−XD. The direct blow-in ratio calculating unit 63 outputs the distribution ratio XC to the intake system suspension ratio calculating unit 64, and outputs the distribution ratio XD of direct blow-in fuel to the combustion chamber suspension ratio calculating unit 65.

The intake system suspension ratio calculating unit 64 calculates a ratio X02 (%) of the fuel remaining in the intake port 4, which is present as a vapor or mist. In the following description, the term suspended fuel comprises vaporized fuel and fuel which is suspended in the form of a mist. The intake system suspension ratio calculating unit 64 also calculates a ratio XE (%) of fuel adhering to the intake port 4 and intake valve 15 by the calculation equation XE=XC−X02.

Hereafter, the fuel adhering to the intake port 4 and the fuel adhering to the intake valve 15 will be referred to generally as intake system adhesion fuel. The intake system suspension ratio calculating unit 64 outputs the distribution ratio X02 (%) of the suspended fuel to the suspension ratio calculating unit 68, and outputs the distribution ratio XE (%) of the intake system adhesion fuel to the intake system adhesion ratio allocating unit 66.

The combustion chamber suspension ratio calculating unit 65 calculates a ratio X03 (%) of suspended fuel in the combustion chamber 5, in the non-vaporized fuel directly blown in to the combustion chamber 5. It also calculates a ratio Xf (%) of fuel adhering to the combustion chamber low temperature wall surface and combustion chamber high temperature wall surface by the calculation equation XF=XD−X03. Hereafter, the fuel adhering to the combustion chamber low temperature wall surface and the fuel adhering to the combustion chamber high temperature wall surface will be referred to generally as combustion chamber adhesion fuel. The combustion chamber suspension ratio calculating unit 65 outputs the distribution ratio X03 of suspended fuel to the suspension ratio calculating unit 68, and outputs the distribution ratio XF of combustion chamber adhesion fuel to a combustion chamber adhesion ratio allocating unit 67.

The intake system adhesion ratio allocating unit 66 allocates the distribution ratio XE of intake system adhesion fuel as a ratio X1 (%) of fuel adhering to the intake valve 15 and a ratio X2 (%) of fuel adhering to the intake port 4.

The combustion chamber adhesion ratio allocating unit 67 allocates the distribution ratio XF of combustion chamber adhesion fuel to a ratio X3 (%) of fuel adhering to the combustion chamber high temperature wall surface and a ratio X4 (%) of fuel adhering to the combustion chamber low temperature wall surface.

The suspension ratio calculating unit 68 sums the distribution ratios X01, X02, X03 of suspended fuel at each site, and calculates a ratio X0 of suspended fuel in the combustion chamber 5.

Next, the method of calculating these distribution ratios will be described.

In order to calculate these distribution ratios, this invention sets a total injected fuel distribution model, a vaporized fuel distribution model, a direct blow-in fuel distribution model, a suspended fuel distribution model, an intake system adhesion fuel distribution model, a combustion chamber adhesion fuel distribution model, and an adhesion fuel vaporization and discharge model.

These models will now be described.

Total Distribution Model of Injected Fuel

Referring to FIGS., 10A–10F, to estimate the distribution ratios X0–X4, the distribution process from the fuel injection timing is represented by six models in time sequence, i.e., injection vaporization, direct blow-in, intake system adhesion and suspension, intake system adhesion, combustion chamber adhesion and suspension, and combustion chamber adhesion.

(1) Injection Vaporization Model

The fuel injected by the fuel injector 21 is a fuel mist of different particle diameters.

Figure 10A:
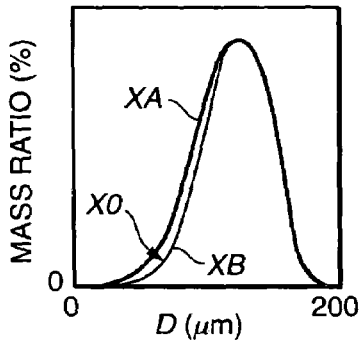
FIGS. 10A–10F are diagrams describing an injected fuel distribution.

According to studies carried out by the inventors, as shown in FIG. 10A, taking the particle diameter D(μm) on the abscissa and the mass ratio (%) on the ordinate, the particle diameter distribution of injected fuel having the distribution ratio XA, has a profile close to that of a normal distribution shown by the thick line in the diagram. The area enclosed by this thick line corresponds to the total injection amount. Part of the injected fuel immediately vaporizes. The smaller the particle diameter is, the easier vaporization is, so as shown by the thin line in the diagram, the vaporized fuel particle distribution having the distribution ratio XB, has a profile wherein small particle diameters have been eliminated from the injected fuel. The area enclosed by the thick line and thin line corresponds to vaporized fuel having the distribution ratio X01.

(2) Direct Blow-in Model

Figure 10B:
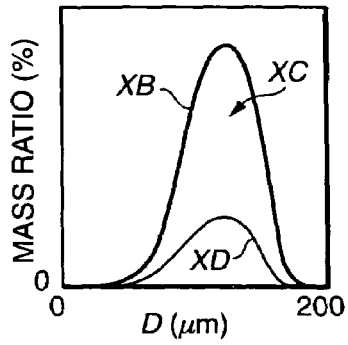

In FIG. 10B, the thick line corresponds to that part of the injected fuel which is not vaporized having the distribution ratio XB, i.e., the thin line in FIG. 10A. Among this, a distribution ratio XD of fuel which is directly blown into the combustion chamber 5 is shown by the thin line. The area enclosed by the thick line and thin line corresponds to fuel having the distribution ratio XC which remains in the intake port 4.

(3) Intake System Adhesion and Suspension Model

Figure 10C:
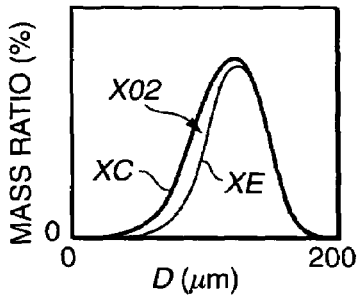

The part of the fuel having the distribution ratio XC which remains in the intake port 4 is suspended as a mist or vapor, and the remainder adheres to the side walls of the intake port 4 and the intake valve 15. The smaller the particle diameter is, the easier suspension is. The thick line in FIG. 10C represents the particle distribution of fuel with the distribution ratio XC remaining in the intake port 4. The intake system adhesion fuel having the distribution ratio XE, as shown by the thin line in the figure, has a profile wherein small particle diameters have been eliminated from the curve for fuel having the distribution ratio XC. The area enclosed by the thick line and thin line corresponds to the suspended fuel in the distribution ratio X02.

(4) Combustion Chamber Adhering and Suspended Fuel

Part of the fuel which is directly blown into the combustion chamber 5 is suspended as a mist or vapor, and the remainder adheres to the combustion chamber high temperature wall surface and combustion chamber low temperature wall surface. The smaller the particle diameter is, the more easily they are suspended. The thick line in FIG. 10E shows the fuel with the distribution ratio XD which is directly blown into the combustion chamber 5. The combustion chamber adhesion fuel with the distribution ratio XF, as shown by the thin line in the figure, has a profile wherein small particle diameters are eliminated from the curve of the fuel having the distribution ratio XD. The area enclosed by the thick line and the thin line corresponds to the suspended fuel having the distribution ratio X03.

(5) Intake System Adhesion Fuel

Figure 10D:
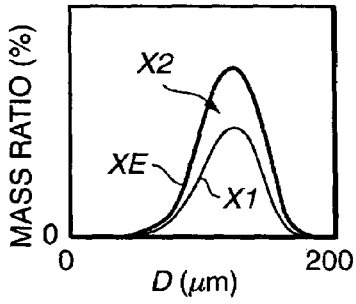
Figure 10E:
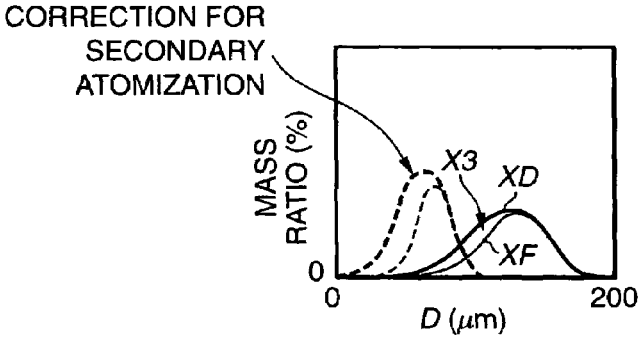

In FIG. 10D, the thick line corresponds to the intake system adhesion fuel XE, i.e., the thin line in FIG. 10C. Among this, fuel having the distribution ratio X1 adhering to the intake valve 15 is shown by the thin line. The area enclosed by the thick line and thin line corresponds to fuel having the distribution ratio X2 adhering to the intake port 4.

(6) Combustion Chamber Adhesion Model

Figure 10F:
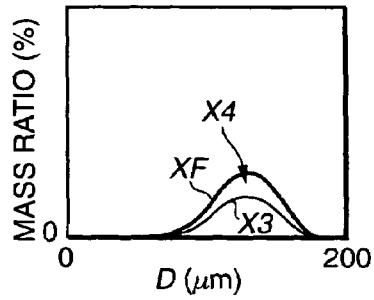

In FIG. 10F, the thick line corresponds to the combustion chamber adhesion fuel having the distribution ratio XF, i.e., the thin line in FIG. 10D. Among this, fuel having the distribution ratio X3 adhering to the combustion chamber high temperature wall surface is shown by the thin line. The area enclosed by the thick line and thin line corresponds to fuel having the distribution ratio X4 adhering to the combustion chamber low temperature wall surface.

In FIGS. 10A–10F, all the fuel curves express the particle diameter distribution as a mass percentage of the injected fuel, and their respective surface areas express ratios relative to the injected fuel, i.e., distribution ratios. The area enclosed by the thick line and the horizontal axis in FIG. 10A is the distribution ratio XA in the total fuel amount injected, and corresponds to 100%.

Next, the method of calculating the distribution ratios XA, XB, XC, XD, XE, XF and X01–X03 will be described.

Figure 11A:
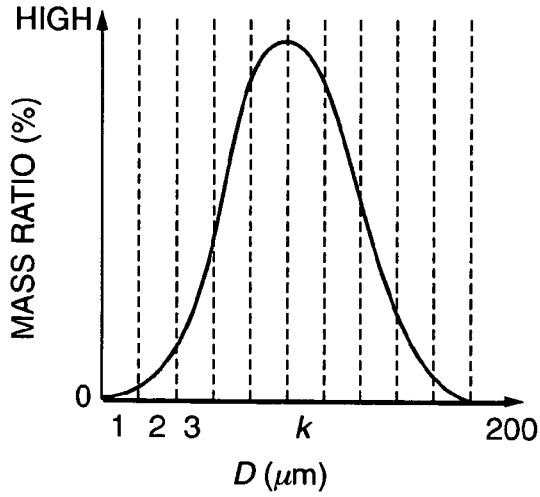
FIGS. 11A and 11B are diagrams showing a relation between an injected fuel particle diameter and a mass ratio.
Figure 11B:
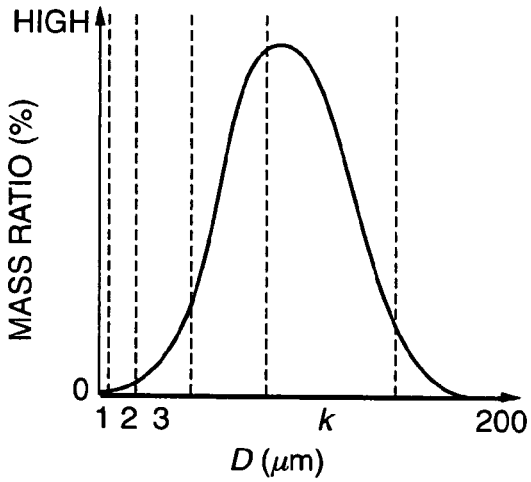

Vaporized Fuel Distribution Model (1) Injected Fuel Particle Diameter Distribution For the injected fuel particle diameter distribution, the results shown in FIG. 11A or FIG. 11B measured in advance for the fuel injector 21, are used.

In FIG. 11A, the particle diameter is divided into equal regions. On the other hand, in FIG. 11B, in the area where the particle diameter is small, the region is divided smaller, and the region unit is increased as the particle diameter increases. Specifically, the width of the region is set to be expressed by 2n (n is a positive integer). Any method may be applied to the particle diameter distribution of the injected fuel XA. The calculation precision increases the larger the number of regions is, but the capacity of the memory (ROM, RAM) required by the controller 31 and the calculation load increase, so the region is preferably set according to the performance of the microcomputer forming the controller 31.

The simplest method is to determine the vaporization ratio and non-vaporization ratio of the injected fuel based on the average particle diameter of the injected fuel in one region. However, the particle diameter distribution may differ even for the same average particle diameter, so the particle diameter distribution area must be divided into plural regions so as to reflect differences in the particle diameter distribution, in the injected fuel vaporization ratio and non-vaporization ratio.

(2) Distribution Ratio X01 of Vaporized Fuel Immediately After Injection

Figure 12:
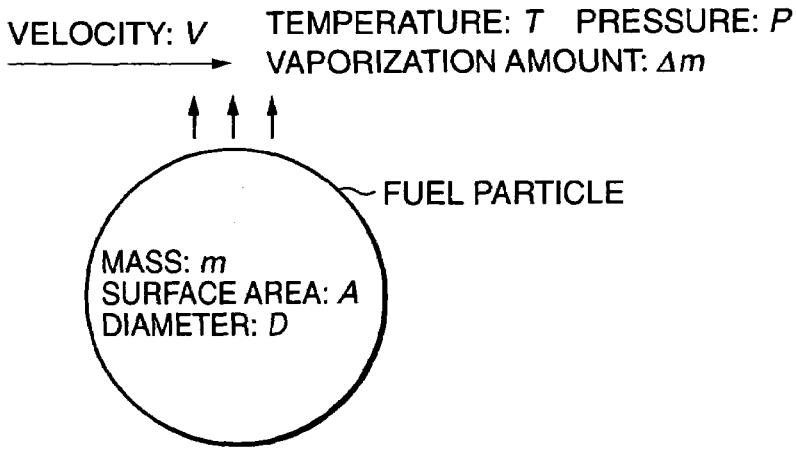
FIG. 12 is a diagram describing an injected fuel vaporization rate.

Referring to FIG. 12, the ratio X01 of vaporized fuel immediately after injection is expressed by the following equations (14) and (15), taking the injected fuel particle mass as m, surface area as A, diameter as D, vaporization amount as Δm, gas flow velocity of the intake port 4 as V, temperature of the intake port 4 as T, and pressure of the intake port 4 as P:

$$X01=\Delta m/m \tag{14}$$

$$\Delta m=f(V,T,P)\cdot A\cdot t \tag{15}$$

f(V,T,P) of equation (14) shows the vaporization amount from the fuel particles per unit surface area and unit time, and in the following description is referred to generally as the vaporization characteristic. The vaporization characteristic f(V,T,P) is a function of the gas flow velocity V of the intake port, intake port temperature T and intake port pressure P. t in equation (15) represents unit time. The pressure P of the intake port 4 is lower than the atmospheric pressure Pa due to the intake negative pressure of the internal combustion engine 1, and is a negative pressure based on the atmospheric pressure Pa.

$$A=D^2\cdot K1\# \tag{16}$$

$$m=D\cdot K2\# \tag{17}$$

where, K1#, K2#=constants.

Substituting equations (16) and (17) in equations (14) and (15), and eliminating Δm, the following equation (18) is obtained:

$$X01=\sum\frac{XAk\cdot f(V,T,P)\cdot A\cdot t\cdot KA\#}{Dk} \tag{18}$$

where, Xak=mass ratio of kth particle diameter region from minimum particle diameter region, Dk=average particle diameter of kth particle diameter region from minimum particle diameter region, and KA#=effective usage rate of gas flow velocity V, which slightly varies according to particle diameter region, but practically may be considered as a constant less than unity.

Σ of equation (18) represents all regions in the particle diameter distribution, i.e., the integral from k=1 to the maximum number of regions.

Figure 13:
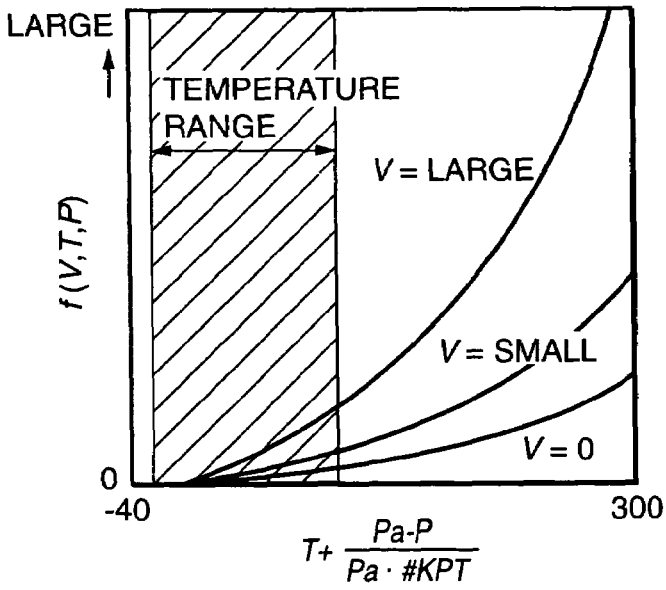
FIG. 13 is a diagram describing the characteristics of an vaporization characteristic f(V,T,P).

The vaporization characteristic f(V,T,P) is found by the controller 31, by looking up a map having the characteristics shown in FIG. 13 which is pre-stored in the internal ROM, from the temperature T and gas flow velocity V of the intake port 4. As shown in the figure, the vaporization characteristic f(V,T,P) takes a larger value, the higher the temperature T and the larger the gas flow velocity V of the intake port 4 are.

In the figure, the vaporization characteristic f(V,T,P) is expressed within a range from minus 40 degrees to plus 300 degrees, but vaporization of the injected fuel actually takes place within a region marked as the temperature range in the figure.

In this map, instead of the temperature T, a value obtained by adding a pressure correction to the temperature T, i.e., $$T + \frac{Pa - P}{Pa \cdot \#KPT},$$

is used on the abscissa Pa is the atmospheric pressure, and #KPT is a constant.

Even if the temperature T of the intake port 4 is identical, if the pressure P is less than the atmospheric pressure Pa as when the internal combustion engine 1 is on low load, fuel vaporizes more easily than when the pressure P is near the atmospheric pressure Pa, as when the engine is on high load. In order to reflect this characteristic in the temperature T, the above pressure-corrected value is used instead of the temperature T for the determination of the vaporization characteristic f(V,T,P).

Among the parameters of the vaporization characteristic f(V,T,P), the gas flow velocity V is a value related to both the flow velocity of the air aspirated to the combustion chamber 5, and the flow velocity of the fuel injected from the fuel injector 21. The latter depends on the spray penetration of the injected fuel. Therefore, in the actual calculation of the ratio X01 of the vaporized fuel immediately after injection, the following equation (19) is used instead of the equation (18):

$$X01 = \sum \frac{XAk \cdot f(Vx, T, P) \cdot A \cdot t1 \cdot KA\#}{Dk} + \sum \frac{XAk \cdot f(Vy, T, P) \cdot A \cdot t2 \cdot KA\#}{Dk} \quad (19)$$

where, Vx=penetration rate of injected fuel, t1=penetration time required by injected fuel, and Vy=intake air flow velocity, and t2=intake air exposure time of injected fuel.

The injected fuel penetration rate Vx and required penetration time t1 are values uniquely determined by a fuel pressure Pf acting on the fuel injector 21. If the internal combustion engine 1 is an engine wherein the fuel pressure Pf is varied, the injected fuel penetration rate Vx and required penetration time t1 are set using the fuel pressure Pf as a parameter.

On the other hand, air intake to the combustion chamber 5 is performed intermittently. Therefore, the intake air flow velocity Vy is directly proportional to the engine rotation speed Ne, and is found by the following equation (20).

$$Vy = Ne \cdot \#KV \quad (20)$$

where, #KV=flow velocity index.

The flow velocity index #KV is determined according to a value obtained by dividing the flow path cross-sectional area of the intake port 4 by the cylinder volume. The flow path cross-sectional area of the intake port 4 and the cylinder volume are known beforehand from the specification of the internal combustion engine 1, and #KV is also known beforehand as a constant value. However, #KV also includes a coefficient for unit adjustment.

Figure 14:
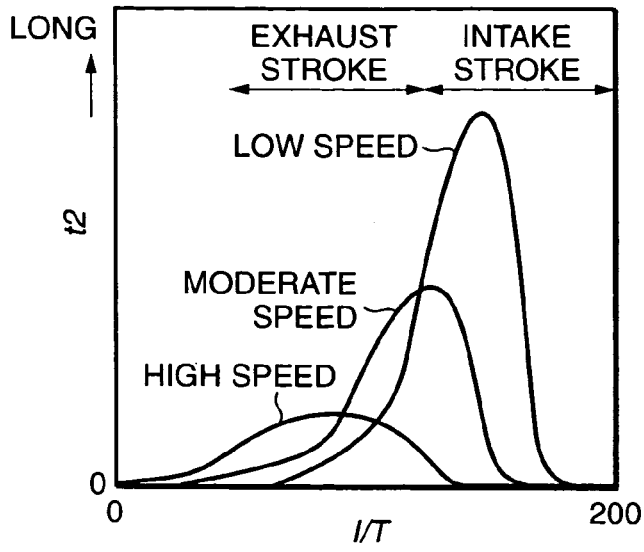
FIG. 14 is a diagram describing the characteristics of an intake air exposure time of injected fuel.

The intake air exposure time t2 of the injected fuel is affected by the fuel injection timing I/T of the fuel injector 21 and the engine rotation speed Ne. The controller 31 calculates the intake air exposure time t2 of the injected fuel by looking up a map having the characteristics shown in FIG. 14, which is pre-stored in the ROM, from the engine rotation speed Ne and fuel injection timing I/T.

Among the parameters in the vaporization characteristic f(V,T,P), the intake air temperature detected by the intake air temperature sensor 44 is used for the temperature T. If the intake air in the combustion chamber 5 contains recirculated exhaust gas due to external exhaust gas recirculation or internal exhaust gas recirculation, the temperature of the recirculated exhaust gas must be taken into account. In this case, the temperature T is found by taking the simple average or weighted average of the cooling water temperature Tw detected by the water temperature sensor 45 and the intake air temperature. The vaporization heat of the injected fuel is not taken into account, and is covered by making an adjustment when the map is drawn up.

Among the parameters in the vaporization characteristic f(V,T,P), the intake air pressure in the intake collector 2 detected by the pressure sensor 46 is used as the pressure P.

(3) Distribution Ratio XB of Non-Vaporized Fuel

The distribution ratio XB of non-vaporized fuel is given by the following equation (21):

$$XB = XA - X01 \quad (21)$$

Distribution Model for Fuel Which is Directly Blown in (1) Distribution Ratio XD of Fuel Which is Directly Blown Into the Combustion Chamber 5

Referring to FIG. 15, when the fuel injector 21 performs an intake stroke injection, part of the fuel is directly blown into the combustion chamber 5 from a gap between the intake valve 15 which has lifted and a valve seat 15C. If the ratio of non-vaporized fuel in the fuel which is directly blown into the combustion chamber 5 is a direct blow-in rate KXD, the distribution ratio of fuel directly blown into the combustion chamber 5 is given by the following equation (22):

$$XD = XB \cdot KXD \quad (22)$$

The direct blow-in rate KXD differs depending on the injection timing I/T and injection direction. The injection direction is expressed by an enclosed angle β subtended by the center axis of the fuel injector 21 and the center axis of the intake valve 15.

Figure 16:
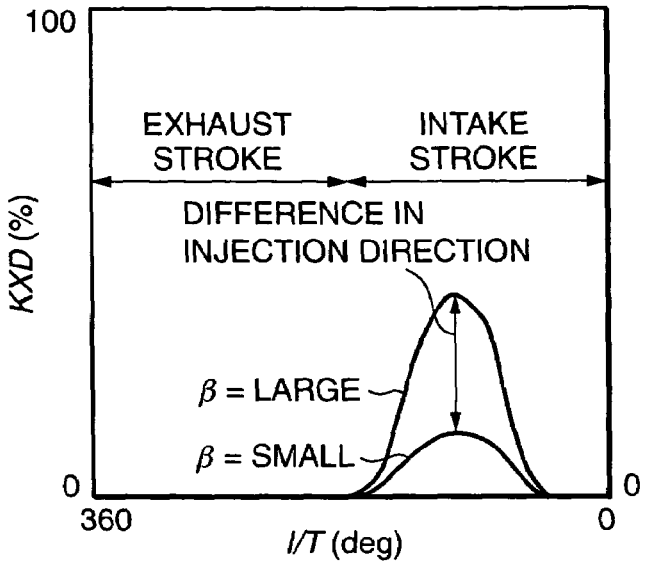
FIG. 16 is a diagram describing a relation between a fuel injection timing and an enclosing angle β between an intake valve and a fuel injector.

The controller 31 calculates the direct blow-in rate KXD from the fuel injection timing I/T and enclosing angle β by looking up a map having the characteristics shown in FIG. 16 which is pre-stored in the ROM. This map is set based on experiment.

If the internal combustion engine I comprises an intake valve operating angle variation mechanism, the lift and the profile of the intake valve 15 have an effect on the direct blow-in rate KXD. In this case, the direct blow-in rate KXD is calculated by the following equation (23):

$$KXD = \frac{KXD0 \cdot H}{H0} \tag{23}$$

where, H=maximum lift of intake valve 15,

H0=basic maximum lift, and

KXD0=direct blow-in rate for basic maximum lift.

The basic maximum lift H0 is the maximum lift of the intake valve 15 when the intake valve operating angle variation mechanism is not operated. When the intake valve operating angle variation mechanism is operated, the maximum lift of the intake valve 15 decreases from H0 to H, and the direct blow-in rate KXD also correspondingly decreases. Equation (23) decreases the direct blow-in rate KXD in direct proportion to the decrease of the maximum lift.

(2) Distribution Ratio XC of Fuel Remaining in the Intake Port 4

The distribution ratio XC of fuel remaining in the intake port 4 is calculated by the following equation (24):

$$XC = XB \cdot XD \tag{24}$$

Distribution Model of Suspended Fuel (1) Distribution Ratio X02 of Fuel Suspended in Intake Port 4

Figure 17:
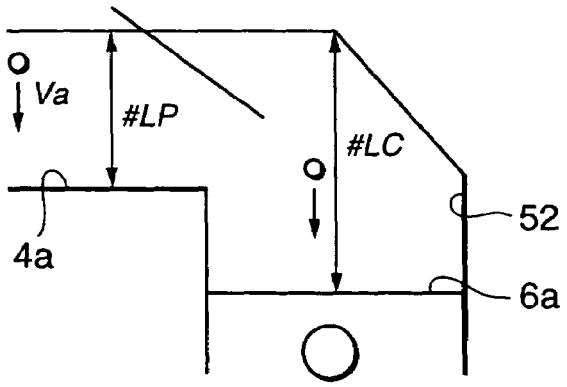
FIG. 17 is a diagram describing an injected fuel suspension state in an intake port and the combustion chamber.

Referring to FIG. 17, a natural descent model is envisaged wherein the fuel in the intake port 4 is uniformly distributed, and mist falls under gravity. It is assumed that fuel which descends and reaches the intake port side wall 4*a* adheres to the intake port side wall 4*a*, and fuel which does not adhere to the intake port side wall 4*a* is suspended.

Figure 18:
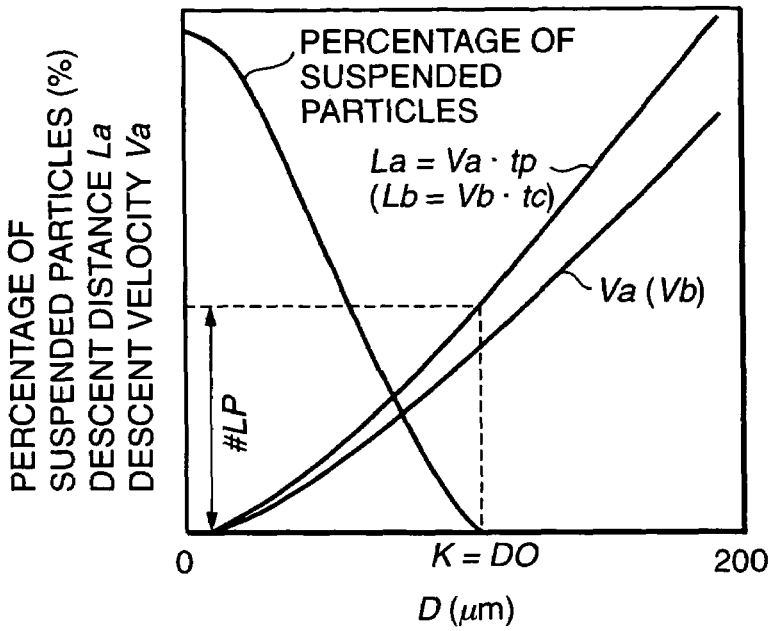
FIG. 18 is a diagram describing a relation between an injected fuel descent velocity and a suspension ratio for different particle diameters.

It will be assumed that a descent velocity Va of fuel particles, as shown in FIG. 18, increases as the particle diameter D of the fuel increases. A descent distance La is calculated by multiplying the descent velocity Va by a suspension time ta.

If the height of the intake port 4 is #LP as shown in FIG. 17, then as shown in FIG. 18, all fuel particles for which the descent distance La exceeds #LP adhere to the intake port side wall 4*a*. The ratio of suspended particles decreases as the particle diameter D increases, and is zero at a particle diameter region k=D0 at which the descent distance La exceeds #LP. Therefore, the sum of suspension ratios for each particle diameter is the distribution ratio X02 of fuel suspended in the intake port 4. This calculation is performed by the following equations (25)–(27):

$$X02 = \sum\left(1 - \frac{Lak}{\#LP}\right) \cdot XCk \tag{25}$$

where, Lak=arrival distance of fuel in particle diameter region k, and

XCk=mass ratio of kth particle diameter region from minimum particle diameter region for intake port residual fuel having distribution ratio XC.

$$Lak = Vak \cdot tp \tag{26}$$

where, Vak=descent velocity of fuel in particle diameter region k, and tp=suspension time of fuel particles.

The suspension time tp of fuel particles is taken as the time from the fuel injection timing I/T to the start of the compression stroke.

Substituting equation (26) into equation (25), equation (27) is obtained:

$$X02 = \sum\left(1 - \frac{Vak \cdot tp}{\#LP}\right) \cdot XCk \tag{27}$$

The controller 31 calculates the distribution ratio X02 of fuel suspended in the intake port 4 by performing the integration of equation (27) from the particle diameter region k=1 to D0, by looking up a map of the descent velocity Vak of fuel for each particle diameter region with the particle diameter D as a parameter, having the characteristics shown in FIG. 18, which is pre-stored in the ROM. For the suspension time tp of the fuel particles, the time from the fuel injection timing I/T to the start of the compression stroke is measured using the timer function of the controller 31. The mass ratio XBk is calculated by looking up a map of particle diameter distribution of fuel remaining in the intake port with the distribution ratio XC, having the characteristics shown by the thick line in FIG. 10C, which is pre-stored in the ROM of the controller 31.

(2) Distribution Ratio X03 of Fuel Suspended in the Combustion Chamber 5

The concept is identical to that for the distribution ratio X02 of fuel suspended in the intake port 4. Specifically, it is assumed that fuel is uniformly distributed in the combustion chamber 5, and descends under gravity. Fuel which has descended to a crown 6*a* of a piston 6 is considered as fuel adhering to the combustion chamber high temperature wall surface.

A descent velocity Vb of fuel particles is read from a map having the characteristics shown in FIG. 18 with the particle diameter D as a parameter. The descent distance Lb of fuel particles is calculated by multiplying the descent velocity Vb by a suspension time tc.

If the height of the combustion chamber 5 is #LC as shown in FIG. 17, all the fuel particles for which the descent distance Lb exceeds #LC, adhere to the crown 6*a*. The ratio of suspended particles decreases as the particle diameter D increases, and is zero at the particle diameter region k=D1 for which the descent distance Lb exceeds #LC. Therefore, the sum of suspension ratios for each particle diameter is the distribution ratio X03 of fuel suspended in the intake port 4. This calculation is performed by the following equations (28)–(30):

$$X03 = \sum\left(1 - \frac{Lbk}{\#\ LC}\right) \cdot XDk \tag{28}$$

where, Lbk=arrival distance of fuel in particle diameter region k, and

XDk=mass ratio of kth particle diameter region from minimum particle diameter region for fuel having distribution ratio XD which is directly blown into the combustion chamber 5.

$$Lbk = Vbk \cdot tc \tag{29}$$

where, Vbk=descent velocity of fuel in particle diameter region k, and tc=suspension time of fuel particles.

The suspension time tc of fuel particles is taken as the time from the fuel injection timing I/T to the start of the compression stroke.

Substituting equation (29) into equation (28), equation (30) is obtained.

$$X03 = \sum\left(1 - \frac{Vbk \cdot tc}{\# LC}\right) \cdot XDk \quad (30)$$

The controller 31 calculates the distribution ratio X03 of fuel suspended in the combustion chamber 5 by performing the integration of equation (30) from the particle diameter region k=1 to D1, by looking up a map of the descent velocity Vbk of fuel for each particle diameter region with the particle diameter D as a parameter, having the characteristics shown in FIG. 18, which is pre-stored in the ROM. For the suspension time tc of the fuel particles, the time from the fuel injection timing I/T to the end of the compression stroke is measured using the timer function of the controller 31. The mass ratio XDk is calculated by looking up a map of particle diameter distribution of fuel which is directly blown into the combustion chamber 5 with the distribution ratio XD, having the characteristics shown by the thick line in FIG. 10E, which is pre-stored in the ROM of the controller 31.

(3) Distribution Ratio XE of Intake System Adhesion Fuel and Distribution Ratio XF of Combustion Chamber Adhesion Fuel The distribution ratio XE of intake system adhesion fuel is calculated by the following equation (31) from the distribution ratio X02 of suspended fuel in the intake port 5:

$$XE = XC - X02 \quad (31)$$

The distribution ratio XF of combustion chamber adhesion fuel is calculated by the following equation (32) from the distribution ratio X03 of suspended fuel in the combustion chamber 5:

$$XF = XD - X03 \quad (32)$$

If the internal combustion engine 1 is provided with an intake valve operating angle variation mechanism, a secondary atomization of fuel particles directly blown into the combustion chamber 5 takes place, so the distribution ratio XD of fuel directly blown into the combustion chamber 5 and the distribution ratio X03 of suspended fuel in the combustion chamber 5 are corrected as follows. The secondary atomization is said to be an atomization of fuel particles which occurs when the intake valve operating angle variation mechanism operates, the maximum lift of the intake valve 15 decreases, and the velocity of air flowing in the gap between the intake valve 15 and valve seat 15 increases.

Referring to FIG. 10E, the secondary atomization makes the particle distribution in the distribution ratio XD of fuel directly blown into the combustion chamber 5 and the distribution ratio X03 of fuel suspended in the combustion chamber 5 vary in the direction of smaller particle diameter, as shown by the thick broken line and thin broken line in the figure. Therefore, if this invention is applied to an internal combustion engine provided with an intake valve operating angle variation mechanism, the distribution ratio XD is calculated by equation (22) using the direct blow-in rate KXD calculated by equation (23) as described above, and the map of particle diameter distribution used in the calculation of the mass ratio XDk, which is used for the calculation of the distribution ratio X03, must be corrected as shown by the thick broken line of FIG. 10E. Practically, when secondary atomization is performed, a particle diameter used for the calculation of XDk may be decreased to about one half of the particle diameter used for the calculation of XDk when secondary atomization is not performed.

Intake System Adhesion Fuel Distribution Model (1) Distribution Ratio X1 of Fuel Adhering to Intake Valve 15, and Distribution Ratio X2 of Fuel Adhering to Intake Port 4

Figure 19:
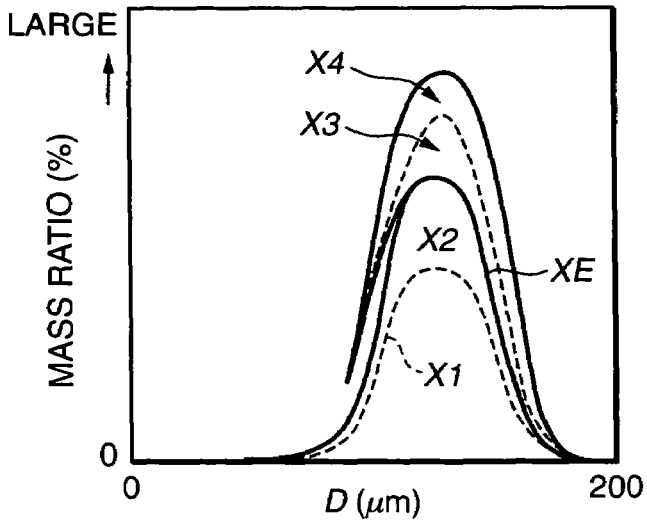
FIG. 19 is a diagram showing an injected fuel particle distribution.

Referring to FIG. 19, the distribution ratio XE of intake system adhesion fuel is represented by the lower solid thick line. Among this, the distribution ratio X1 of fuel adhering to the intake valve 15 is represented by the lower broken line in the figure. The area enclosed by the two curves corresponds to the distribution ratio X2 of fuel adhering to the intake port 4.

Hence, the controller 31 divides the distribution ratio XE of intake system adhesion fuel into the distribution ratios X1, X2 by the following equations (33) and (34) using the intake valve direct adhesion rate #DVR:

$$X1 = XE \cdot KX1 \quad (33)$$

$$X2 = XE - X1 \quad (34)$$

where, KX1=intake valve direct adhesion coefficient.

Figure 20:
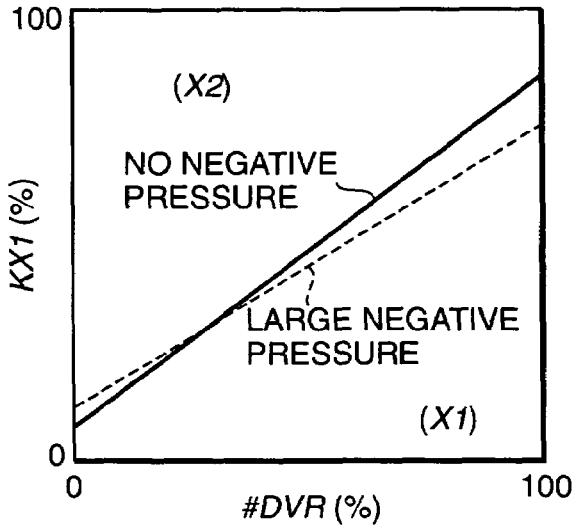
FIG. 20 is a diagram describing the characteristics of an intake valve direct adhesion coefficient KX1.

The controller 31 calculates the intake valve direct adhesion coefficient KX1 by looking up a map having the characteristics shown in FIG. 20 which is pre-stored in the ROM, from the intake valve direct adhesion rate #DVR and pressure P of the intake valve 4.

Referring to FIG. 20, the intake valve direct adhesion coefficient KX1 increases as the intake valve direct adhesion rate #DVR increases. Also, for an identical intake valve direct adhesion rate #DVR, it takes a smaller value when the internal combustion engine 1 is on low load when the pressure P is small, than when it is on high load. The "high negative pressure" shown in the figure corresponds to low load when the pressure P is much less than the atmospheric pressure Pa. "No negative pressure" corresponds to high load when the pressure P is substantially equal to the atmospheric pressure Pa.

The intake valve direct adhesion rate #DVR shows the ratio of fuel which strikes the intake valve 15 in the fuel injected by the fuel injector 21. The intake valve direct adhesion rate #DVR is a value calculated geometrically beforehand according to the design of the intake port 4, intake valve 15 and fuel injector 21.

(2) Ratio X3 of Fuel Adhering to Combustion Chamber High Temperature Wall Surface, and Ratio X4 of Fuel Adhering to Combustion Chamber Low Temperature Wall Surface Referring to FIG. 19, the distribution ratio XF of combustion chamber adhesion fuel is the sum of the ratio. X3 of fuel adhering to the combustion chamber high temperature wall surface, and the ratio X4 of fuel adhering to the combustion chamber low temperature wall surface.

Hence, the controller 31 divides the distribution ratio XF of combustion chamber adhesion fuel into the distribution ratios X3, X4 by the equations (35) and (36) using an allocation rate KX4:

$$X4 = X \cdot KX4 \quad (35)$$

$$X3 = XF - X4 \quad (36)$$

Figure 21:
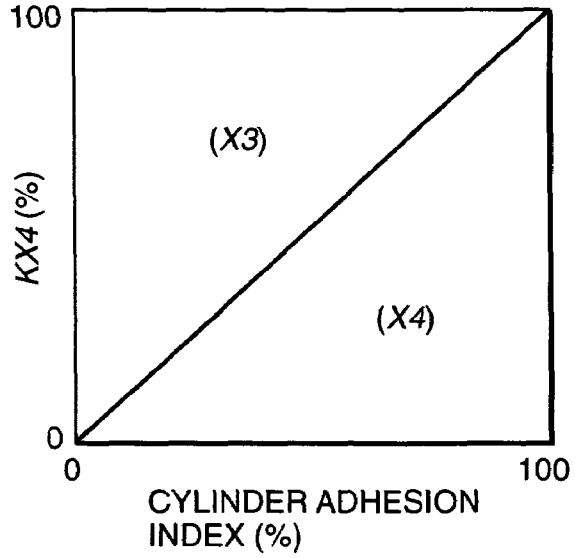
FIG. 21 is a diagram describing the characteristics of an allocation rate KX4.

The controller 31 calculates the allocation rate KX4 from the cylinder adhesion index by looking up a map having the characteristics shown in FIG. 21 which is pre-stored in the ROM. The cylinder adhesion index shows the ratio of fuel adhering to a cylinder wall surface 5*b*, among the combustion chamber adhesion fuel due to fuel which is directly blown into the combustion chamber 5 from the gap between the intake valve 15 and valve seat 15C.

For example, assuming the profile of the fuel injected by the fuel injector 21 to be conical, and taking the ratio blown into the combustion chamber 5 from the gap between the intake valve 15 and valve seat 15C as B, and the ratio adhering to the cylinder wall surface 5*b* in the ratio B as A, A/B corresponds to the cylinder adhesion index. Referring to FIG. 21, as the cylinder adhesion index increases, the allocation rate KX4 also increases. The cylinder adhesion index can be set from a gas flow simulation model or from a wall flow recovery experiment according to site by a simple substance test.

As described above, the controller 31 calculates the distribution ratios X0, X1, X2, X3, X4 according to the overall injected fuel distribution model in FIGS. 10A–10F.

Compared to the case where the distribution ratios X0, X1, X2, X3, X4 are calculated by directly looking up a map based on running conditions such as the temperature, rotation speed and load signals, by using a physical model, the distribution ratios X0, X1, X2, X3, X4 can be precisely calculated without performing hardly any experimental adaptation for different engines. Also, the information relating to the injected fuel particle distribution is useful to improve combustion efficiency and exhaust performance.

Next, the adhesion fuel vaporization and discharge model will be described.

Adhesion Fuel Vaporization and Discharge Model

The basic concept in the case where the adhesion fuel, i.e., the wall flow, is represented by a physical model, will first be described.

i. Wall Flow Vaporization

Figure 22:
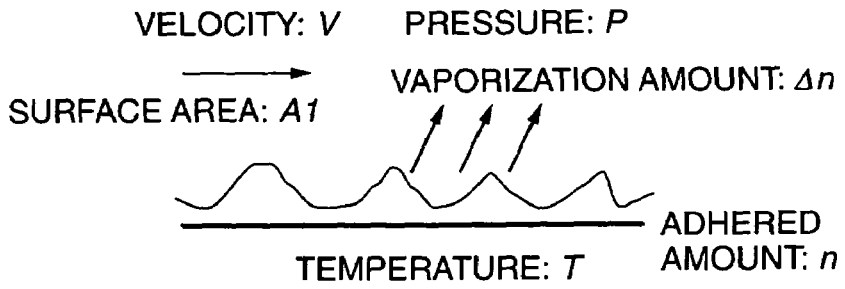
FIG. 22 is a diagram describing fuel vaporization from wall flow.

Referring to FIG. 22, a wall flow vaporization model will be described. A wall flow vaporization surface area A1 is directly proportional to the height of a wall flow wave. Assuming that the wave height is directly proportional to the adhering amount n, the following equation (37) holds:

$$A1=n\cdot K\# \tag{37}$$

where, k#=constant.

Further, it is assumed that a vaporization amount Δn from the wall flow is given by the following equation (38):

$$\Delta n=f(V,T,P)\cdot A1 \tag{38}$$

f(V,T,P) is the wall flow vaporization characteristic, and the wall flow vaporization characteristic applied to equation (15) for calculating the injected fuel vaporization amount Δm can be used without modification. However, equation (38) differs from equation (15) in that it is not multiplied by the unit time t. In other words, the vaporization amount Δn given by equation (38) corresponds to a vaporization rate.

From equations (37) and (38), equation (39) representing a wall flow vaporization rate $y_0$, is obtained:

$$y_0=\frac{\Delta n}{n}=f(V,T,P)\cdot K\# \tag{39}$$

Equation (39) shows that the vaporization amount is directly proportional to the adhering amount n.

ii. Wall Flow Discharge

Figure 23:
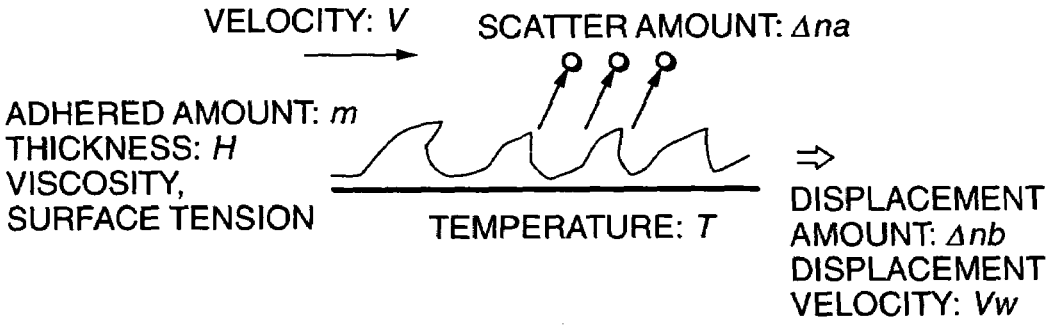
FIG. 23 is a diagram describing scatter from wall flow and displacement of wall flow.

Referring to FIG. 23, a model of wall flow scatter and wall flow displacement will now be described. Wall flow discharge is an expression which generally refers to wall flow scatter and wall flow displacement. Scatter means fuel which is stripped off the wall flow and scatters, while displacement means fuel which moves over the surfaces of members such as the wall surface.

Figure 24:
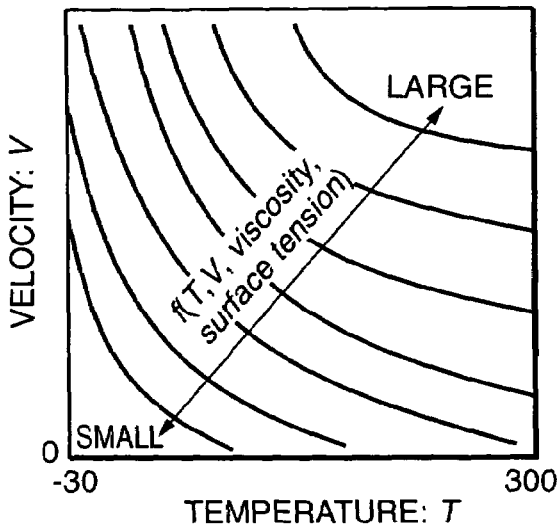
FIG. 24 is a diagram describing the characteristics of a scatter ratio basic value.

A wall flow scatter amount. Δna is directly proportional to the height of the wall flow wave. Assuming that the wave height is directly proportional to the adhering amount n, a wall flow scatter rate y is given by the following equation (40):

$$y=\frac{\Delta na}{n}=f(T,V,\text{viscosity},\text{surface tension})\cdot K\# \tag{40}$$

f(T, V, viscosity, surface tension) in equation (39) is a scatter rate basic value having the characteristics shown in FIG. 24. A map of these characteristics depending on the viscosity and surface tension of the gasoline used by the internal combustion engine 1 is pre-stored in the ROM of the controller 31. The scatter rate basic value increases the higher the temperature T of the intake port 4 is, and increases the higher the gas flow velocity V of the intake port 4 is.

It is also assumed that the wall flow scatter amount is directly proportional to the adhering amount n.

Figure 25:
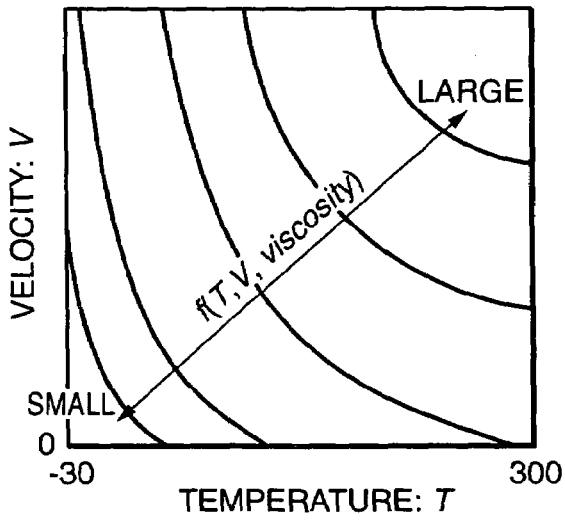
FIG. 25 is a diagram describing the characteristics of a displacement ratio basic value.

In FIG. 23, the wall flow moves due to the effect of the gas flow velocity V. Assuming that a wall flow displacement velocity Vw is not affected by the wall flow height h, a wall flow displacement amount Δnb and wall flow height h are given by the following equations (41) and (42):

$$\Delta nb=h\ Vw \tag{41}$$

$$h=n\cdot K\# \tag{42}$$

$$Vw=f(T,V,\text{viscosity}) \tag{43}$$

f(T,V, viscosity) in equation (43) is a displacement rate basic value having the characteristics shown in FIG. 25. A map having these characteristics depending on the viscosity of the gasoline used by the internal combustion engine 1, is pre-stored in the ROM of the controller 31. The displacement rate basic value increases the higher the temperature T of the intake port 4 is, and the higher the gas flow velocity V of the intake port 4 is. By applying the equations (41)–(43), the wall flow displacement rate y' is given by the following equation (44).

$$y'=\frac{\Delta nb}{n}=f(V,T,\text{viscosity})\cdot K\# \tag{44}$$

It is also assumed that the wall flow displacement amount is directly proportional to the adhering amount n. As described above, considering that the wall flow vaporization amount and discharge amount are both directly proportional to the adhering amount n, the following wall flow model can be constructed.

Figure 26:
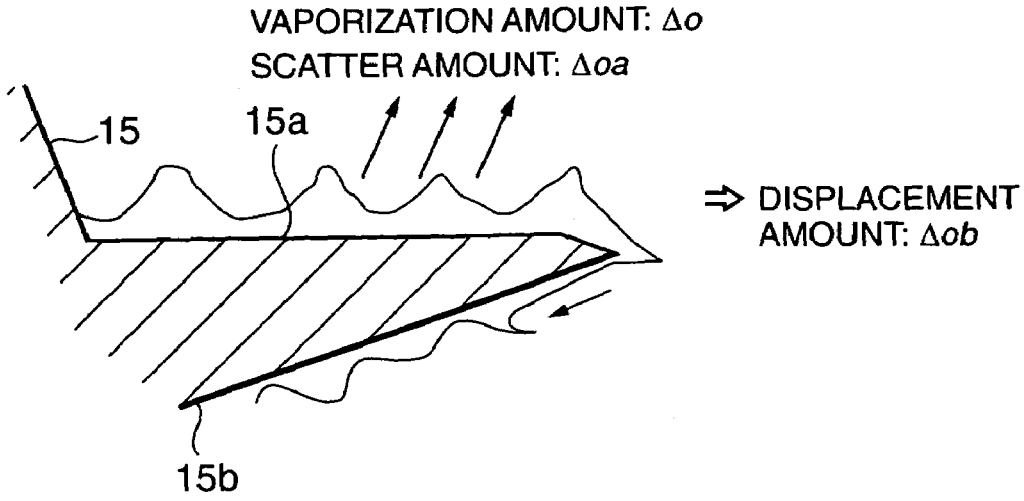
FIG. 26 is a diagram describing vaporization and removal from an intake valve wall flow.

Application of Vaporization and Discharge to Different Site Models (1) Application to Intake Valve Wall Flow Referring to FIG. 26, the wall flow vaporization model of FIG. 22 and wall flow discharge model of FIG. 23 are applied to the behavior analysis of the intake valve wall flow. Due to these models, an adhering amount o of the intake valve 15 is separated into a vaporization amount Δo, a scatter amount Δoa and a displacement amount Δob. Among the scatter amount Δoa, the fuel amount that adheres to the combustion chamber high temperature wall surface will be referred to as Δoa1, and the fuel amount that adheres to the combustion chamber low temperature wall surface will be referred to as Δoa2. Among the displacement amount Δob, the fuel amount that adheres to the combustion chamber high temperature wall surface will be referred to as Δob1, and the fuel amount that adheres to the combustion chamber low temperature wall surface will be referred to as Δob2.

Among the intake valve wall flow, a vaporization amount ratio Y0, ratio Y1 that is a ratio of the fuel amount that becomes wall flow on the combustion chamber high temperature wall surface, and ratio Y2 that is a ratio of the fuel amount that becomes wall flow on the combustion chamber low temperature wall surface, are calculated by the following equations (45)–(47):

$$YO = \frac{\Delta o}{o} = f(V, T, P) \cdot \#\ KWVV \tag{45}$$

where, f(V,T,P)=vaporization characteristic shown in FIG. 13, and

#KWVV=predetermined vaporization coefficient.

$$Y1 = \frac{\Delta oa1 + \Delta ob1}{o} = f(T, V, \text{viscosity, surface tension}) \cdot \#\ KVC + f(T, V, \text{viscosity}) \cdot \#\ KVT \tag{46}$$

where, f(T,V, viscosity, surface tension)=scatter rate basic value of wall flow shown in FIG. 24,

#KVC=ratio adhering to combustion chamber high temperature wall surface in scatter amount of intake valve wall flow, f(T,V, viscosity)=displacement rate basic value of wall flow shown in FIG. 25, and

#KVT=ratio adhering to combustion chamber high temperature wall surface in displacement amount of intake valve wall flow.

$$Y2 = \frac{\Delta oa2 + \Delta ob2}{o} = \frac{(1 - \Delta oa1) + (1 - \Delta ob1)}{o} = f(T, V, \text{viscosity, surface tension}) \cdot (1 - \#\ KVC) + f(T, V, \text{viscosity}) \cdot (1 - \#\ KVT) \tag{47}$$

(2) Application to Intake Port Wall Flow

Figure 27:
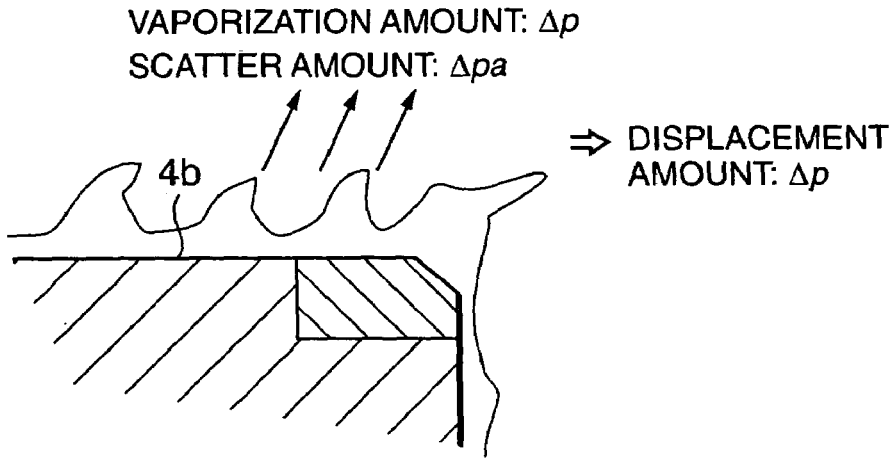
FIG. 27 is a diagram describing vaporization and removal from an intake port wall flow.

Referring to FIG. 27, the wall flow vaporization model shown in FIGS. 22 and the wall flow discharge model shown in FIG. 23 are applied to the behavior analysis of the intake port wall flow. Due to these models, an adhering amount p of the intake port 4 is separated into a vaporization amount Δp, scatter amount Δpa and displacement amount Δpb. Among the scatter amount Δpa, the fuel that adheres the combustion chamber high temperature wall surface will be referred to as Δpa1, and the fuel that adheres to the combustion chamber low temperature wall surface will be referred to as Δpa2. Among the displacement amount Δpb, the fuel that adheres to the combustion chamber high temperature wall surface is referred to as Δpb1, and the fuel that adheres to the combustion chamber low temperature wall surface is referred to as Δpb2.

Among the intake port wall flow, a vaporization amount ratio Z0, ratio Z1 that is a ratio of the fuel amount that becomes wall flow on the combustion chamber high temperature wall surface and ratio Z2 that is a ratio of the fuel amount that becomes wall flow on the combustion chamber low temperature wall surface are calculated by the following equations (48)–(50):

$$Z0 = \frac{\Delta p}{p} = f(V, T, P) \cdot \#\ KWVP \tag{48}$$

where, f(V,T,P)=vaporization characteristic shown in FIG. 13, and

#KWVPV=predetermined vaporization coefficient.

$$Z1 = \frac{\Delta pa1 + \Delta pb1}{p} = f(T, V, \text{viscosity, surface tension}) \cdot \#\ KHC + f(T, V, \text{viscosity}) \cdot \#\ KHT \tag{49}$$

where, f(T,V, viscosity, surface tension)=scatter rate basic value of wall flow shown in FIG. 24,

#KHC=ratio adhering to combustion chamber high temperature wall surface in scatter amount of intake port wall flow, f(T,V, viscosity)=displacement rate basic value of wall flow shown in FIG. 25, and

#KHT=ratio adhering to combustion chamber high temperature wall surface in displacement amount of intake port wall flow.

$$Z2 = \frac{\Delta pa2 + \Delta pb2}{p} = \frac{(1 - \Delta pa1) + (1 - \Delta pb1)}{p} = f(T, V, \text{viscosity, surface tension}) \cdot (1 - \#KHC) + f(T, V, \text{viscosity}) \cdot (1 - \#KHT) \tag{50}$$

The values of gas flow velocity V, temperature T and pressure P required to determine the wall flow vaporization characteristic f(V,T,P), scatter rate basic value f(T,V, viscosity, surface tension) and displacement rate basic value f(T,V, viscosity) used to apply to the vaporization and discharge models for various sites are different depending on the model.

To determine the vaporization characteristic and basic values applied to the intake valve wall flow, the gas flow velocity V, temperature T and pressure P in the part 15*b* of the intake valve 15, are used. The temperature of the part 15*b* can be calculated from the cooling water temperature Tw and the running conditions of the internal combustion engine 1 by applying a method known in the art disclosed in Tokkai Hei 3-134237 published by the Japan Patent Office in 1991.

On the other hand, the cooling water temperature Tw or a temperature lower by a fixed amount than the cooling water temperature Tw is used for the temperature of the intake port 4. The fixed amount may be taken for example as 15 degrees Centigrade.

For the gas flow velocity V and pressure P, identical values are used for the intake valve wall flow and the intake port wall flow. As the flow velocity V, the intake flow velocity Vy calculated by equation (20) is used. Further, if secondary atomization due to the intake valve operating angle variation mechanism is taken into account, the flow velocity index #KV is modified by decrease -correction of the flowpath cross-sectional area of the intake port 4.

As the pressure P, the intake pressure of the intake collector 2 detected by the pressure sensor 46 is used.

The vaporization coefficients #KWVV, #KWVP, coefficients #KVC, #KHC relating to scatter amount, and coefficients #KVT, #KHT relating to displacement amount are given as functions of the wetted surface area of the wall flow and the displacement distance, and are set in advance by experiment.

As described above, the behavior of the intake valve wall flow and the behavior of the intake port wall flow are calculated separately, but the calculation equations are identical and only the parameters are different, so the number of adaptations required is less.

(3) Application to Combustion Chamber High Temperature Wall Flow

Figure 28:
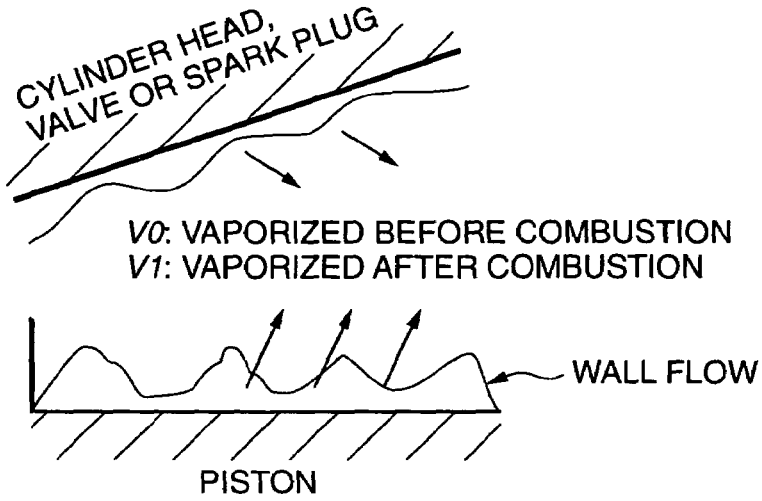
FIG. 28 is a diagram describing vaporization from a combustion chamber wall flow.

Referring to FIG. 28, a wall flow vaporization model similar to that of FIG. 22 is applied to the behavior analysis of the wall flow of the combustion chamber high temperature wall surface. A vaporized burnt amount V0 of wall flow which vaporizes and burns, and a vaporized unburnt discharge amount V1 of wall flow which is discharged as unburnt fuel gas, are calculated by the following equations (51) and (52) using the map of the vaporization characteristic f(V,T,P) shown FIG. 13:

$$V0=f(V,T,P)\cdot\#KCV \tag{51}$$

$$V1=f(V,T,P)\cdot\#KCL \tag{52}$$

where, #KCV=vaporization coefficient prior to combustion of combustion chamber high temperature wall flow, and

#KCL=vaporization coefficient after combustion of combustion chamber high temperature wall flow.

(4) Application to Combustion Chamber Low Temperature Wall Flow

Figure 29:
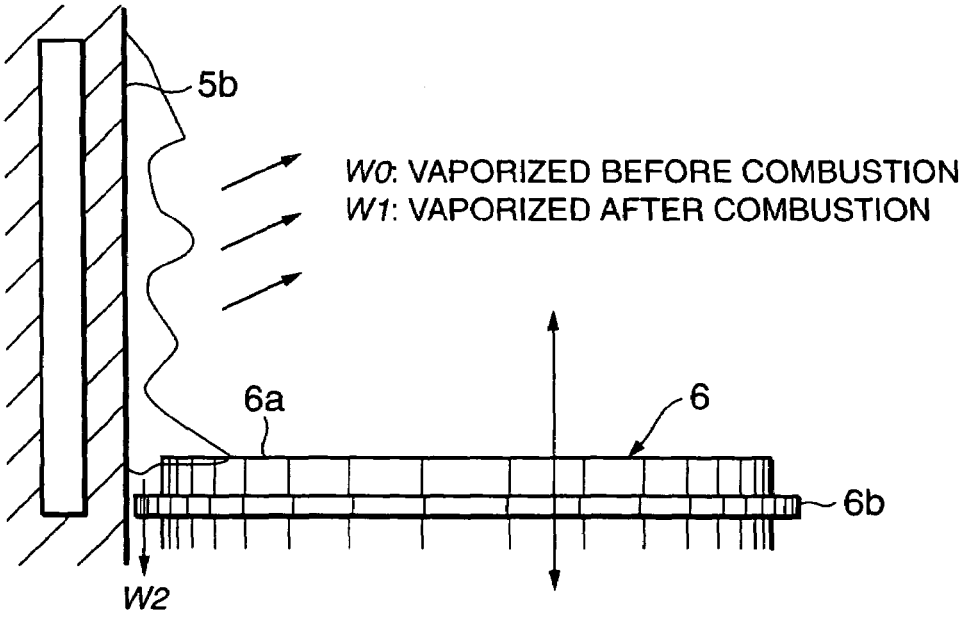
FIG. 29 is a diagram describing vaporization and removal from a cylinder surface wall flow.

Referring to FIG. 29, a wall flow vaporization model similar to that of FIG. 22 is applied to the behavior analysis of the wall flow of the combustion chamber low temperature wall surface. A vaporized burnt amount W0 of wall flow which vaporizes and burns, and a vaporized unburnt discharge amount W1 of wall flow which is discharged as unburnt fuel gas, are calculated by the following equations (53) and (54) using the map of the vaporization characteristic f(V,T,P) shown in FIG. 13.

$$W0=f(V,T,P)\cdot\#KBV \tag{53}$$

$$W1=f(V,T,P)\cdot\#KBL \tag{5}$$

where, #KBV=vaporization coefficient prior to combustion of combustion chamber low temperature wall flow, and

#KCL=vaporization coefficient after combustion of combustion chamber low temperature wall flow.

Further, the fuel amount which mixes with the lubricating oil from the gap between the cylinder side wall 5*b* and piston 6 and flows out to the crankcase, is calculated by the following equation (55) using the wall flow discharge model:

$$W2=f(Ne,Tp)\cdot\#KBO \tag{55}$$

where, f(Ne, Tp)=oil mixing rate basic value having the characteristics shown in FIG. 30, and

#KBO=oil mixing coefficient of combustion chamber low temperature wall flow.

As shown in FIG. 30, when the basic fuel injection amount Tp is constant, the oil mixing rate basic value f (Ne, Tp) used in equation (55) takes a smaller value, the higher the engine rotation speed Ne is. Also, when the engine rotation speed Ne is constant, it takes a higher value, the larger the basic fuel injection amount Tp is.

Next, the temperature T, gas flow velocity V and pressure P required to calculate the vaporization characteristic f(V,T, P) prior to combustion used in the equations (51) and (53), and the temperature T, gas flow velocity V and pressure P required to calculate the vaporization characteristic f(V,T,P) after combustion used in the equations (52) and (54), will be described.

(A) Temperature T: Referring to FIGS. 31A–31C, for one combustion cycle of the internal combustion engine 1, the temperature of the combustion chamber 5 varies with the pattern shown in the figure. Therefore, the combustion cycle is divided into two parts, i.e., a vaporization region prior to combustion and a vaporization region after combustion, and the average temperature is estimated from estimation values for the gas temperature and wall surface temperature for each region. The average temperature varies depending on the load and rotation speed of the internal combustion engine 1, so an average speed map having load and rotation speed as parameters is experimentally drawn up beforehand, and the controller 31 looks up this map based on the load and rotation speed to calculate the average temperature in each region. In this map, the load of the internal combustion engine 1 is represented by the basic fuel injection amount Tp. Regarding the estimation values of wall surface temperature, the estimation value of the temperature of the combustion chamber high temperature wall surface is used to calculate the values V0, V1 relating to the combustion chamber high temperature wall flow, and the estimation value of the temperature of the combustion chamber low temperature wall surface is used to calculate the values W0, W1 relating to the combustion chamber low temperature wall flow. For the estimation value of the temperature of the combustion chamber high temperature wall surface, an exhaust gas temperature TEXH detected by the exhaust gas temperature sensor 48 may be used. For the estimation value of the temperature of the combustion chamber low temperature wall surface, the cooling water temperature Tw detected by the water temperature sensor 45 may be used.

(B) Pressure P: Referring to FIGS. 31A–31C, for one combustion cycle of the internal combustion engine 1, the pressure of the combustion chamber 5 varies with the pattern shown in the figure. Therefore, the combustion cycle is divided into two regions, i.e., a vaporization region prior to combustion and a vaporization region after combustion, and the average pressure is estimated for each region. The average pressure varies depending on the load and rotation speed of the internal combustion engine 1, so an average pressure map having load and rotation speed as parameters is experimentally drawn up beforehand, and the controller 31 looks up this map based on the load and rotation speed to calculate the average pressure in each region. In this map, the load of the internal combustion engine 1 is represented by the basic fuel injection amount Tp.

(C) Flow velocity V: Referring to FIGS. 31A–31C, for one combustion cycle of the internal combustion engine 1, the gas flow velocity in the combustion chamber 5 varies with the pattern shown in the figure. This pattern is directly proportional to the intake flow velocity Vy obtained in equation (20), and it may be assumed that the intake flow velocity Vy has decreased, so the average flow velocity V in the vaporization region prior to combustion and the average flow velocity Vd in the vaporization region after combustion are calculated by the following equations (56), (57):

$$V=Vy\cdot\#KIV \tag{56}$$

$$Vd=Vy\cdot\#KIL \tag{57}$$

where, #KIV, #KIL=constants.

As described above, the behavior of the combustion chamber high temperature wall flow and the behavior of the combustion chamber low temperature wall flow are calculated separately, but the calculation equations are basically identical, and as only the parameters are different, the number of adaptations can be reduced.

In this fuel injection control device, for the behavior of the injected fuel, i.e., calculation of XB, XC, XD, XF, X01, X02, X03, and for the behavior of the wall flow, i.e., calculation of Y0, Y1, Y2, Z0, Z1, Z2, V0, V1, W0, W1, W2, a large number of coefficients are used based on the specification of the internal combustion engine 1 and the specification of parts such as the fuel injector 21. These maps must be set at least once experimentally. However, if the same fuel injector 21 is applied to an engine having a different specification, for the maps depending on the injected fuel particle diameter or particle diameter distribution, there is no need to make any modifications, so that compared to the fuel injection control device of the prior art, the number of adaptations required by engine specification changes can be largely reduced.

Next, referring to FIG. 32, FIGS. 33A and 33B, FIG. 34 and FIGS. 35A and 35B, a second embodiment of this invention will be described.

Figure 32:
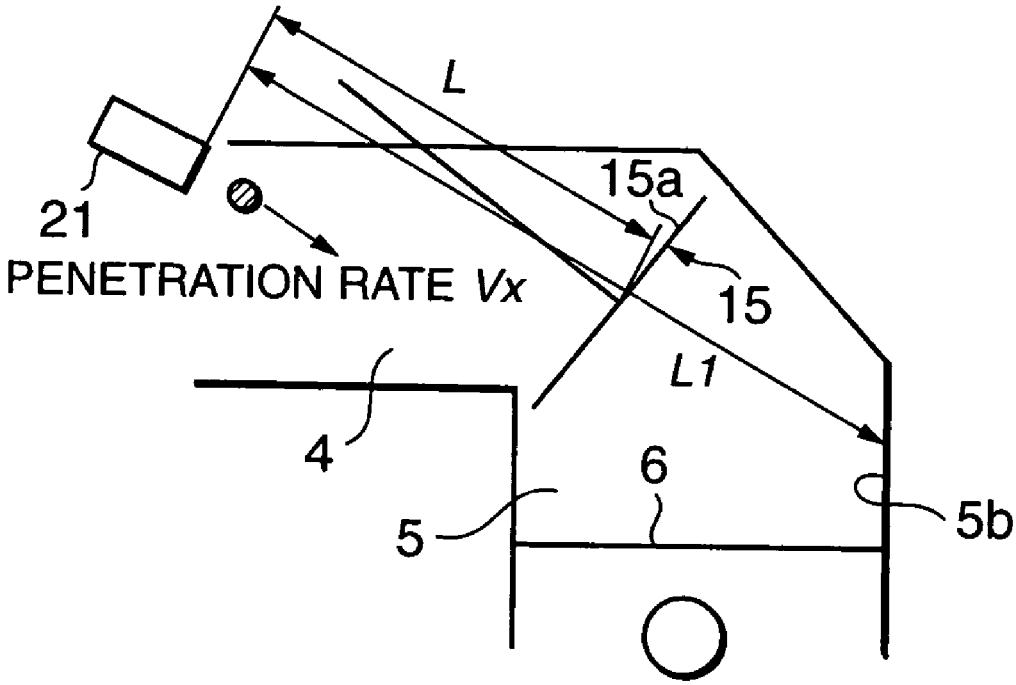
FIG. 32 is a diagram describing a wall surface arrival state of injected fuel according to a second embodiment of this invention.

FIG. 32 shows a model of combustion chamber wall surface arrival of the injected fuel. In this model, it is assumed that the injected fuel penetrates at an equal penetration rate in the injection direction, and does not stop midway. The suspension time tp of fuel particles from the fuel injection timing I/T to the start of the compression stroke, is set in the same way as in the first embodiment. It is assumed that fuel particles for which an arrival distance during the suspension time tp does not reach the distance L from the spray nozzle of the fuel injector 21 to the part 15*a* of the intake valve 15, are suspended in the intake port 4.

On the other hand, particles whose arrival distance during the suspension time tp exceeds the distance L either adhere to the intake valve 15 or are directly blown into the combustion chamber 5. The ratio of fuel adhering to the intake valve 15 and fuel directly blown into the combustion chamber 5 is determined by the intake valve direct adhesion rate #DVR.

Further, it is assumed that, among the fuel which is directly blown into the combustion chamber 5, fuel particles for which the arrival distance during the suspension time tp does not reach a distance L1 from the spray nozzle of the fuel injector 21 to the cylinder wall surface 5*b*, are suspended in the combustion chamber 5. On the other hand, particles for which the arrival distance during the suspension time tp exceeds the distance L1, adhere to the cylinder wall surface 5*b*.

Figure 33B:
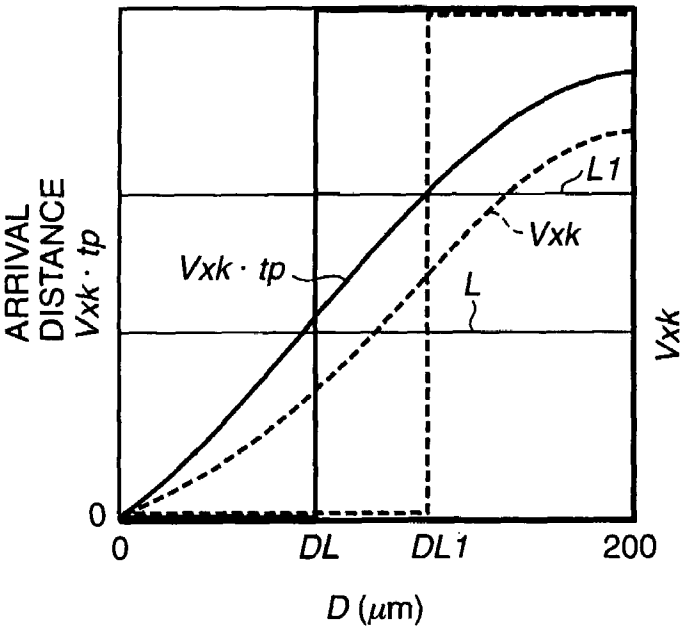
FIGS. 33A and 33B are diagrams describing the characteristics of a distribution ratio, an injected fuel arrival distance and an arrival ratio with respect to an injected fuel particle diameter.
Figure 33A:
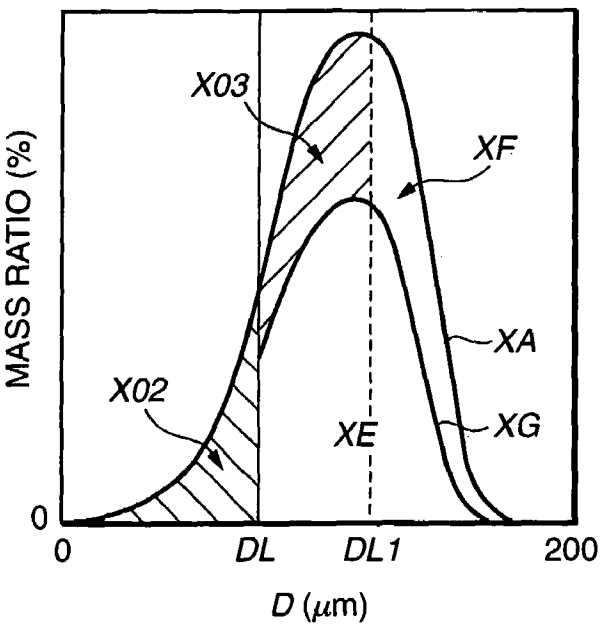

Referring to FIGS. 33A and 33B, according to the aforesaid assumptions, the fuel injected from the fuel injector 21 may be classified into four types. The curve situated in the uppermost part of FIG. 33A represents the particle diameter distribution of the injected fuel XA from the fuel injector 21.

A particle diameter DL is the particle diameter for which the arrival distance during the suspension time tp is equal to L. A particle diameter DL1 is the particle diameter for which the arrival distance during the suspension time tp is equal to L1.

A particle diameter region from the particle diameter DL to DL1 in FIG. 33A is referred to as the combustion chamber suspension particle diameter region, and the particle diameter region beyond the particle diameter DL is referred to as the combustion chamber adhesion particle diameter region.

The distribution ratio X02 of the suspended fuel in the intake port 4 is equal to a value obtained by integrating the curve XA which is a function of the particle diameter D, for the particle diameter D from zero to DL.

The curve XG is a curve obtained by multiplying the curve XA by the intake valve direct adhesion coefficient KX1 based on the intake valve direct adhesion rate #DVR. This curve represents the particle distribution of the fuel adhering to the intake valve 15. The distribution ratio XE of fuel adhering to the intake valve 15 is equal to a value obtained by integrating the curve XG for the particle diameter D from DL to the maximum particle diameter. It should be noted that in this embodiment the injected fuel penetrates only in the direction of the fuel injection. In other words, it is assumed that the injected fuel does not adhere to the take port side wall 4*a*.

In FIG. 33A, the region enclosed by the curves XA and XG and the verticle line corresponding to the particle diameter DL shows the fuel present in the combustion chamber 5. Among this, the surface area of the combustion chamber suspension particle diameter region from the particle diameter DL to DL1, corresponds to the distribution ratio X03 of suspended fuel in the combustion chamber 5. The surface area of the combustion chamber adhesion particle diameter region from the particle diameter DL1 to the maximum particle diameter, corresponds to the ratio XF of fuel adhering to the combustion chamber low temperature wall surface and combustion chamber high temperature wall surface. These four surface areas can be calculated by integration or by finding the sum of the values for each particle diameter region.

In this embodiment, it is assumed that the penetration rate Vx of fuel injected by the fuel injector 21 depends on the particle diameter D.

Process #1: A map is drawn up beforehand of the penetration rate Vx divided into small regions having the particle diameter D as a parameter, and stored in the ROM of the controller 31. In this map, the penetration rate Vx increases as the particle diameter D increases. The controller 31 calculates X02, X03, XE and XF by the following processes #1–#4.

Process #2: The suspension time tp is calculated by looking up a predetermined map from the engine rotation speed Ne of the internal combustion engine 1 and the fuel injection timing I/T of the fuel injector 21. An arrival distance Vxk·tp of fuel particles due to scatter is calculated for each particle diameter region k by multiplying the suspension time tp by the penetration rate Vxk. Vxk means the penetration rate Vx of particles in reglion k. Referring to FIG. 33B, the arrival distance also increases as the particle diameter D increases.

Process #3: The particle diameter DL when the arrival distance Vxk·tp coincides with the distance L, and the particle diameter DL 1 when the arrival distance Vxk·tp coincides with the distance DL1, are calculated from a map corresponding to FIG. 33B.

Further, for the particle diameter distribution curve XA in FIG. 33A, the distribution ratio X02 of fuel suspended in the intake port 4 is calculated by the following equation (58). This calculation is performed over the regions from k=1 to D=DL.

$$X02 = \sum_{k=1}^{D=DL} XAk \tag{58}$$

Process #4: The particle diameter distribution curve XA in FIG. 33A is multiplied by the intake valve direct adhesion coefficient KX1 to obtain the curve XG. Regarding the curve XG, the mass ratio of all the regions from D=DL to the maximum particle diameter is integrated to obtain the distribution ratio XE of fuel adhering to the intake valve 15 by the following equation (59):

$$XE = \sum_{D=DL}^{D=DL1} XGk \tag{59}$$

Process #5: The distribution ratio X03 of fuel suspended in the combustion chamber 5 is integrated by the following equation (60). This integration is performed for all the regions from D=DL to D=DL1. The distribution ratio XF of combustion chamber adhesion fuel is integrated by the following equation (61). This integration is performed for all the regions from D=DL1 to the maximum diameter:

$$X03 = \sum_{D=DL}^{D=DL1} (XAk - XGk) \tag{59}$$

$$XF = \sum_{D=DL1}^{D=Dmax} (XAk - XGk) \tag{60}$$

Among the above Processes #1–#5, Process #1 can be executed in advance. Therefore, the processing performed by the controller 31 during the running of the internal combustion engine 1 is the Processes #2–#5.

As described above, according to this embodiment, X02, X03, XE and XF can be easily calculated.

Figure 34:
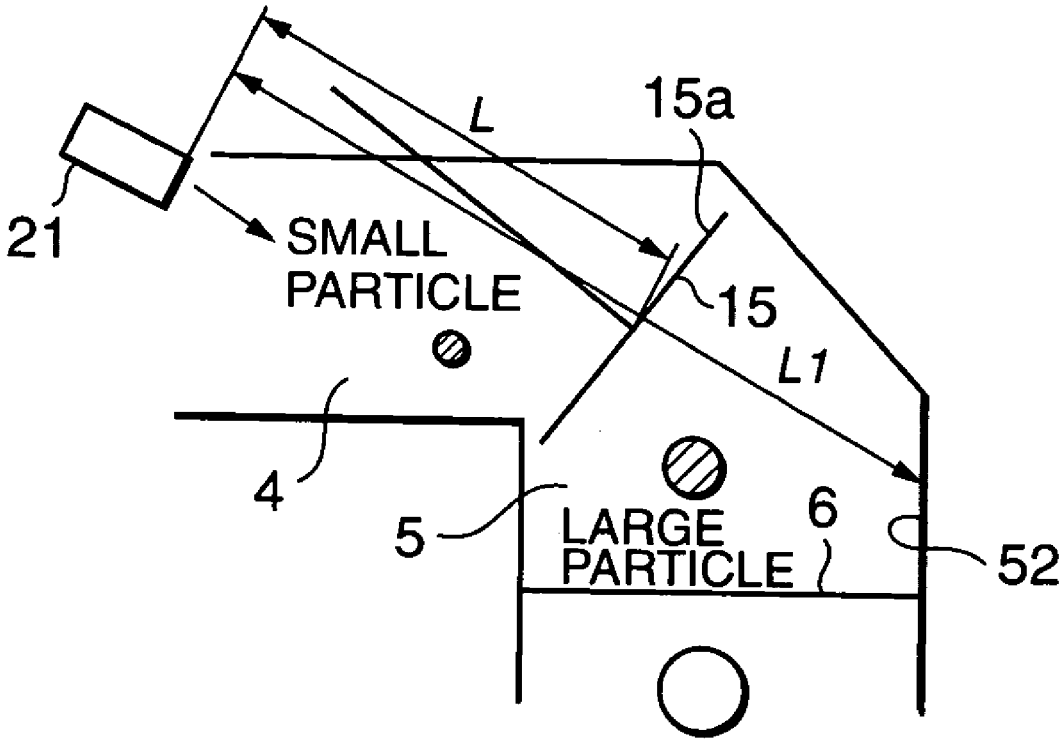
FIG. 34 is similar to FIG. 32, but showing a variation of the second embodiment.
Figure 35B:
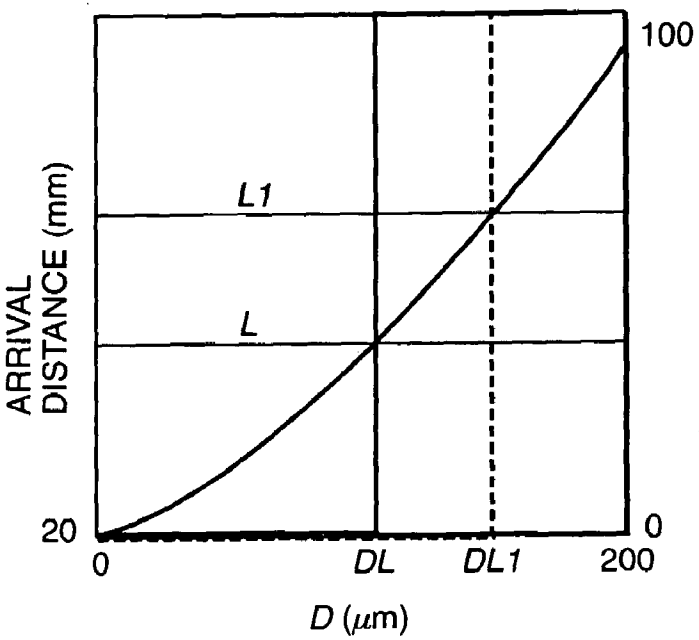
FIGS. 35A and 35B are diagrams describing the characteristics of the distribution ratio, injected fuel arrival distance and arrival ratio with respect to the injected fuel particle diameter according to the variation of the second embodiment.
Figure 35A:
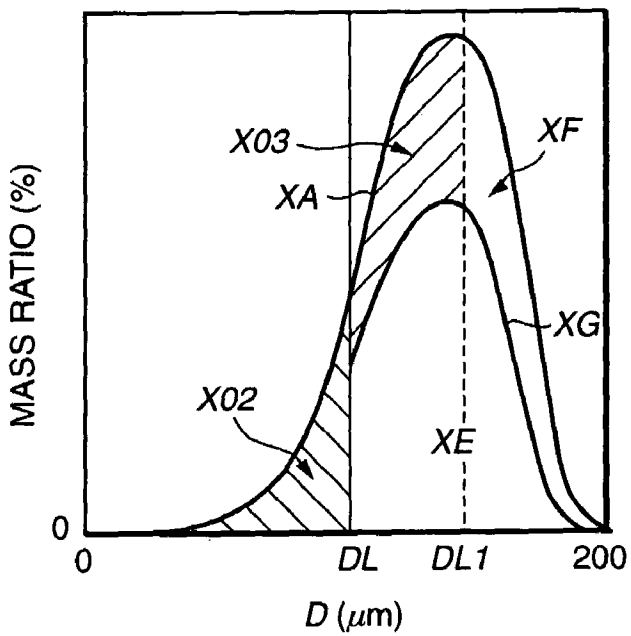

In this embodiment, the setting is such that the penetration rate Vx of the injected fuel increases as the particle diameter D of the injected fuel increases, and the arrival distance due to scatter for each particle diameter D is calculated by multiplying the penetration rate Vx by the suspension time tp. However, as shown in FIG. 34, assuming that the arrival distance due to scatter increases as the particle diameter D increases, a map of arrival distance due to scatter of the injected fuel having the particle diameter D and the suspension time tp as parameters may also be drawn up instead of the map of penetration rate Vx. In this case, the penetration rate Vx and suspension time tp are not multiplied together, and DL, DL1 are calculated directly by looking up a map having the characteristics shown in FIG. 35 from the arrival distance due to scatter.

Next, referring to FIG. 36, and FIGS. 37A, 37B, a third embodiment of this invention will be described.

In this embodiment, the injected fuel from the fuel injector 21 is considered as being a cylindrical block 81, and that the velocity of the injected fuel is a constant value #VF depending on the average particle diameter D of the injected fuel regardless of the particle diameter distribution of the injected fuel. The ratio XD (%) of fuel directly blown into the combustion chamber 5 is calculated based on this concept.

Referring to FIG. 37B, the leading edge of the block 81 of injected fuel is injected at a time #t0, and the trailing edge of the block 81 of injected fuel is injected at a time #t1. The leading edge of the block 81 reaches a distance L to the part 15*a* of the intake valve 15 at a time #t4.

In this embodiment, it is assumed that after the leading edge of the block 81 has reached the intake valve 15, the intake valve 15 opens, and after the intake valve 15 has opened, part of the fuel reaching the intake valve 15 is directly blown into the combustion chamber 5. Further, it is assumed that among the fuel blown into the combustion chamber 5, fuel for which the arrival distance has reached a predetermined distance #LM1 adheres to the wall surface of the combustion chamber 5.

Conversely, among the fuel directly blown into the combustion chamber 5, the ratio per unit time of fuel stagnating in the suspended state in the combustion chamber 5 is taken as a unit combustion chamber suspension ratio FC (%). It is assumed that the intake valve 15 opens near to the end of the exhaust stroke, and that the unit combustion chamber suspension ratio FC increases from zero at a time #t3 when the intake valve 15 starts to open.

At a time #t5, the trailing edge of the injected fuel reaches the combustion chamber 5. Subsequently, fuel does not enter the combustion chamber 5. On the other hand, the arrival distance of fuel entering the combustion chamber 5 together with the start of the compression stroke does not reach the arrival distance #L1 corresponding to the wall surface of the combustion chamber 5 until a time #t6. Therefore, in the interval from the time #t3 to #t6, the total amount of fuel injected into the combustion chamber 5 stays in the suspended state without adhering to the wall surface of the combustion chamber 5.

After the time #t6 when the leading edge reaches the wall surface of the combustion chamber 5, the unit combustion chamber suspension ratio FC decreases. At a time #t7, the trailing edge of the injected fuel reaches the wall surface of the combustion chamber 5, and the unit combustion chamber suspension ratio FC becomes zero.

After the time #t5 at which the trailing edge of the injected fuel reaches the combustion chamber 5, during the interval up to the time #t6 when the leading edge reaches the wall surface of the combustion chamber 5, the unit combustion chamber suspension ratio FC is a constant value. As a result, the unit combustion chamber suspension ratio FC has a trapezoidal profile as shown in FIG. 37B.

The method of calculating the ratio XD (%) of fuel directly blown into the combustion chamber 5 based on the above behavior model, will now be described.

First, if the injected fuel can freely enter the combustion chamber 5 depending on the arrival distance, the mass ratio of fuel staying in the suspended state in the combustion chamber 5 is calculated as a latent combustion chamber suspension mass ratio XGA, by the following equation (62):

$$XGA = \sum_{j=1}^{j=MAX} \frac{100 - f(V, T, P) \cdot A \cdot t \cdot KA\#}{D} \cdot FCj \quad (62)$$

where, FCj=unit combustion chamber suspension ratio FC corresponding to jth timeframe divided into unit times t.

j is the region number which increases by one for each unit time t up to a time #t7, taking the unit time including the time #t2 when the intake valve 15 starts to open as 1. The controller 31 performs the integration of equation (62) from j=1 to a maximum value MAX.

Equation (62) is an equation which takes account of the fact that the fuel obtained by subtracting fuel which has vaporized in the intake port 4 from the injected fuel, enters the combustion chamber 5, and fuel corresponding to the unit combustion chamber suspension ratio FC is present in the combustion chamber 5 in the suspended state. The average particle diameter is used for the particle diameter D. The vaporization characteristic f(V,T,P) of the fuel particles, surface area A, unit time t and effective usage rate KA# are identical values to those applied to equation (18) of the first embodiment.

Regarding the gas flow velocity V, unlike the first embodiment, a relative flow velocity of the flow velocity #VF of injected fuel relative to the intake air flow velocity (VP−VG), is used. VP is the flow velocity when the piston 6 is moving downwards, and VG is a blow-back partial flow velocity.

Referring to FIG. 37A, the intake air flow velocity of the intake port 4 is zero during most of the exhaust stroke, but when there is an overlap at the end of the exhaust stroke, i.e., when the intake valve 15 and exhaust valve 16 are both open, a gas flow in the reverse direction to the intake air is set up in the intake port 4 due to blow-back of the combustion gas. After the change-over to the intake stroke, an intake air flow velocity depending on the downward displacement of the piston 6 is set up. The flow velocity V is determined by taking account of these flow velocities. The determination method will be described later.

As the intake valve 15 is situated at the inlet of the combustion chamber 5, only part of the latent combustion chamber suspension mass ratio XGA calculated by equation (61) is actually blown into the combustion chamber 5. This ratio XD (%) is calculated by the following equation (63):

$$XD = XGA\ \#KXD2\ \#X1 \quad (63)$$

where, #*KXD2* = direct blow-in rate
= constant positive value less than 1.0, and
#*X1* = correction value for injected fuel density
= constant positive value less than 1.0.

Specifically, the controller 31 calculates the ratio XD blown into the combustion chamber 5 by the following processes #1–#7.

Process #1: The suspension ratio FCj for each unit time from the time #t3 to #t7 is calculated by the following equations (64)–(66):

When t<t5, $$FC = \frac{(t - \#t3) \cdot \#VF}{(\#t5 - \#t3) \cdot \#VF} \quad (64)$$

When #5≦t≦#6, $$FC = 1.0 \quad (65)$$

When T≧#t6, $$FC = \frac{[(\#t7 - \#t6) \cdot \#VF - (t - \#t6) \cdot \#VF]}{(\#t7 - \#t6) \cdot \#VF} \quad (66)$$

From the time #t3–#t7, the value of FC obtained by the equations (63)–(65) per unit time t is pre-stored as FCj together with the number of the region j in the ROM of the controller 31.

Process #2: Among the intake flow velocities, the blow-back partial flow velocity VG at the time #t3 when the intake valve 15 opens, is calculated by the following equation (67):

$$VG = VGP \quad (67)$$

where, VGP=initial value of the blow-back partial flow velocity VG.

The blow-back partial flow velocity VG after the time t3 is repeatedly calculated for each unit time t by the following equation (68):

$$VG = VG_{n-1} - \#GG \quad (68)$$

where, $VG_{n-1}$=immediately preceding value of VG, and #GG=flow velocity decrease amount=constant value.

The calculation of VG by equation (68) is performed within a range of positive values. In FIG. 37A, the blow-back flow velocity is shown as a negative value, but the blow-back flow velocity VG calculated by equations (67) and (68) is a positive value. Whether the flow velocity is a positive value or a negative value, the effect on the vaporization of injected fuel is identical, so it has been shown as a positive value here. VGP used in equation (67) is calculated by looking up a predetermined map based on Pm/Pa. Herein, Pm is the intake air pressure of the internal combustion engine 1, and Pa is atmospheric pressure.

Process #3: The flow velocity VP of the intake air due to the downward displacement of the piston 6 after the time #t4 at which the intake stroke starts, is calculated by the following equation (69):

$$VP = VPP \cdot Ne \cdot KPV \quad (69)$$

where, VPP=downward velocity of piston 6,

Ne=rotation speed of internal combustion engine 1, and

KPV=constant.

The time #t4 corresponds to exhaust top dead center of the piston 6. A downward velocity VPP of the piston 6 is calculated by looking up a piston position map which is pre-stored in the ROM of the controller 31 based on a value obtained by converting t–#t4 to a crank angle, selecting two values close to the conversion values on the map, and directly taking the slope of the line joining these values. The constant #KPV is calculated by multiplying $$\frac{\text{capacity of cylinder volume}}{\text{cross-sectional area of intake passage of internal combustion engine 1}}$$

by the constant #K1.

Process #4: the controller 31 calculates the relative flow velocity Vper unit time t by the following equation (70):

$$V=|VP-VG-\#VF| \tag{70}$$

In equation (70), I–VG–#VF|=IVG+#VF| is the relative flow velocity between the injected fuel flow velocity #VF and the blow-back flow velocity VG.

Regarding the interval from the time #t3 to the time #t7, the relative flow velocity Vj is calculated by equation (70) per unit time t, and the value obtained is pre-stored in the ROM of the controller 31 together with the number of the region j.

Process #5: Based on the relative flow velocities V1, V2, V3, . . . , Vj of injected fuel, the temperature T of the intake port 4 and the pressure P of the intake port 4, the vaporization characteristic (Vj, T, P) for each time interval j is calculated by looking up a map having the characteristics shown in FIG. 13.

Process #6: The latent combustion chamber suspension mass ratio XGA is integrated by the following equation (71):

$$XGA = \sum_{j=1}^{j=\mathrm{MAX}} \frac{100 - f(Vj, T, P)\cdot A\cdot t\cdot KA\#}{D}\cdot FCj \tag{71}$$

Process #7: The latent combustion chamber suspension mass ratio XGA is substituted into equation (63), and the ratio XD (%) of fuel directly blown into the combustion chamber 5 is calculated. The time #t3 corresponds to the first time in the claims, the time #t6 corresponds to the second time in the claims, the time #t5 corresponds to the third time in the claims, and the time #t7 corresponds to the fourth time in the claims.

According to this embodiment, the ratio XD (%) of fuel which is directly blown into the combustion chamber 5 can be calculated by a simple model.

Next, referring to FIGS. 38–41, a fourth embodiment of this invention will be described.

In the third embodiment, in equation (62) used in Process #7, the direct blow-in rate was set as the constant #KXD2, but in this embodiment, in order to enhance the precision of calculating the ratio XD (%) of fuel which is directly blown into the combustion chamber 5, the direct blow-in rate is given as a variable KXD3 based on the model.

Figure 38:
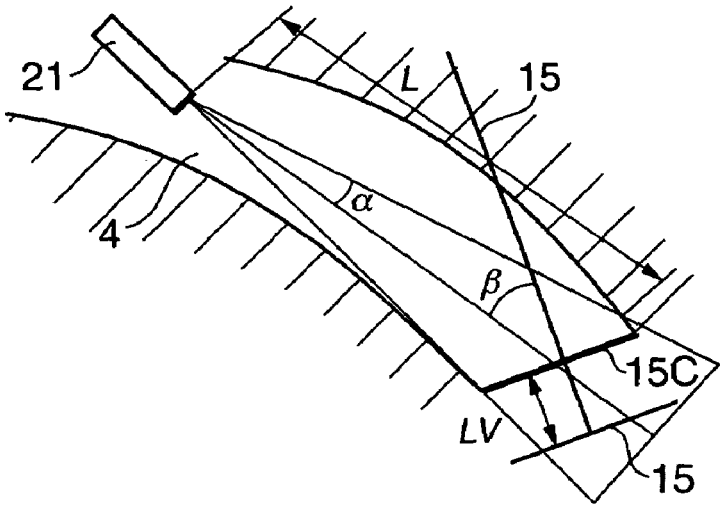
FIG. 38 is a diagram defining a fuel injection profile providing that the fuel injection is in the form of a cone according to a fourth embodiment of the invention.

Referring to FIG. 38, in this model, it is assumed that the diameter of the fuel injected by the fuel injector 21 increases depending on the distance from the fuel injector 21, and has a conical profile. The enclosed angle β between the intake valve 15 and fuel injector 21, a fuel injection angle γ, and a lift amount Lv of the intake valve 15 are respectively defined as shown in the figure.

Figure 39:
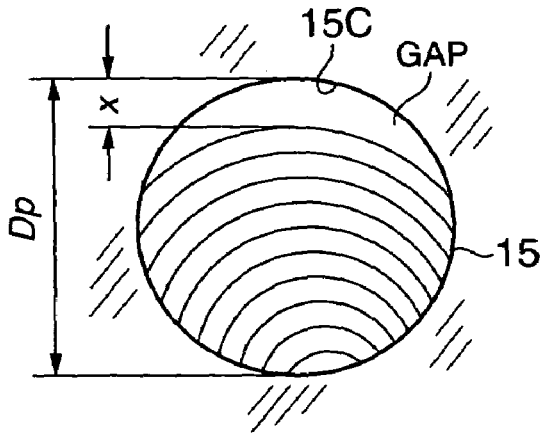
FIG. 39 is a diagram describing a surface area ratio according to the fourth embodiment of the invention.

Referring to FIG. 39, a ratio XD (%) of fuel which is directly blown into the combustion chamber 5, when the gap between the intake valve 15 and the valve seat 15C in the lift state is viewed from the fuel injector 21, varies according to a surface area ratio Ks of the cross-sectional surface area of the gap and the cross-sectional surface area of the intake port 4. These cross-sectional surface areas are surface areas measured in a direction perpendicular to the center axis of the fuel injector 21.

The surface area ratio Ks, in this embodiment, is approximately given by the following equation (72):

$$Ks = \frac{x}{Dp} \tag{72}$$

where, x=maximum width of the gap between intake valve 15 and valve seat 15C measured on FIG. 39, and Dp=diameter of intake port 4 measured in same direction as gap width x on FIG. 39.

Even if the cross-section of the intake port 4 is circular, the cross-section when viewed from the fuel injector 21 is conical, as shown in FIG. 39. The diameter Dp corresponds to the short axis of the ellipse.

The gap width x is given by equations (73)–(75):

$$x = \frac{w\cdot L}{L+h} = \frac{Lv\cdot Kw\cdot L}{L+Lv\cdot Kh} = \tag{73}$$

where, L=distance from fuel injector 21 to valve seat 15C, and

Lv=lift amount of intake valve 15.

$$w = \frac{Lv\cdot\sin(\gamma+\beta)}{\cos\gamma} = Lv\cdot Kw \tag{74}$$

where, γ=fuel injection angle of fuel injector 21,

β=angle enclosed between intake valve 15 and fuel injector 21, and $$Kw = \frac{\sin(\gamma+\beta)}{\cos\gamma}. \tag{75}$$

$$h = \frac{Lv\cdot\cos\beta}{\cos\gamma} = Lv\cdot Kh$$

$$\text{where, } Kh = \frac{\cos\beta}{\cos\gamma}.$$

Substituting equation (73) into equation (72), the surface area ratio Ks is given by the following equation (76):

$$Ks = \frac{\left(\frac{Lv\cdot Kw\cdot L}{L+Lv\cdot Kh}\right)}{Dp} = f1(Lv) \tag{76}$$

γ and β are known values, and Kw, Kh are constants. L and Dp are known values from the specifications of the fuel injector 21 and internal combustion engine 1. Therefore, the surface area ratio Ks is given as a function of the lift amount Lv of the intake valve 15.

In this embodiment, the lift amount Lv from opening to closing of the intake valve 15 is divided into intervals for predetermined crank angles, and combinations of the interval number q and lift amount Lvq are pre-stored in the ROM of the controller 31.

Further, in this embodiment, the setting of the correction value of the fuel injection density is different from that of the third embodiment.

In the third embodiment, in Process #7, the ratio XD (%) of fuel directly blown into the combustion chamber 5 is calculated using equation (63). In equation (63), the correction value #XI1 of the injected fuel density is taken as a constant value. In this embodiment, the correction value of the injected fuel density is given as a function XI2 of the lift amount Lv of the intake valve 15.

Figure 40:
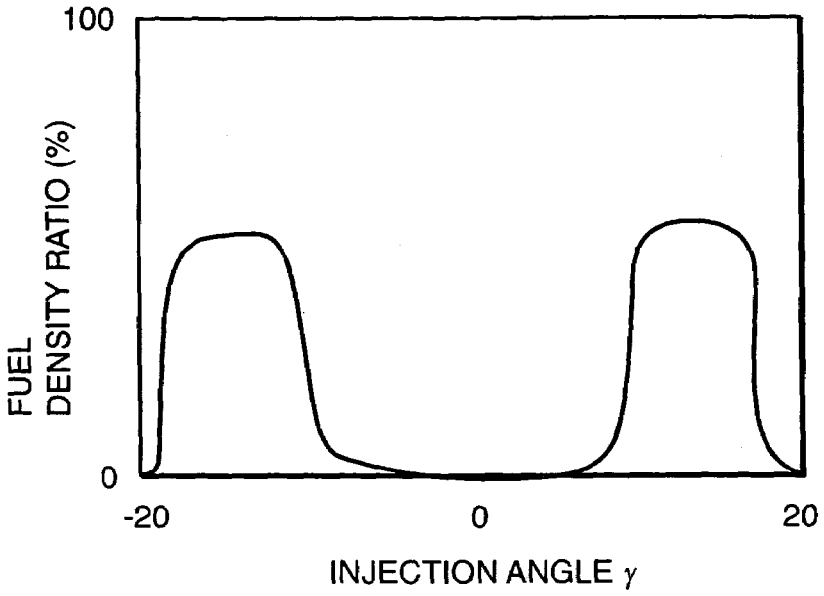
FIG. 40 is a diagram describing a distribution of an injected fuel density according to the fourth embodiment of the invention.

The fuel injected from the fuel injector 21 is considered to have a conical profile as described above, but the fuel density in each part of this cone is not uniform. Referring to FIG. 40, the fuel density increases, the larger the absolute value of the injection angle γ is, i.e., the nearer it is to the circumference of the cone. Therefore, the correction value of the injected fuel density varies depending on which part of the cone is facing the gap between the intake valve 15 and valve seat 15C.

Figure 41:
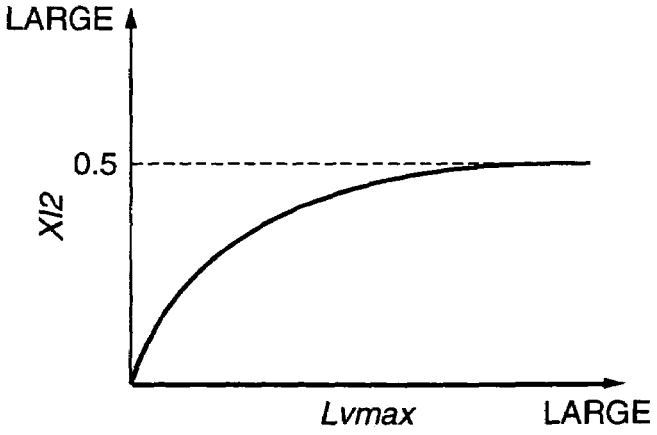
FIG. 41 is a diagram describing the characteristics of a map of a correction value XI2 of the injected fuel density according to the fourth embodiment of the invention.

In this embodiment, as shown in FIG. 41, it is assumed that the correction value XI2 of the injected fuel density varies according to a maximum value Lvmax of the lift amount Lv of the intake valve 15. A map of the correction value XI2 of the injected fuel density having the characteristics shown in FIG. 41 is pre-stored in the ROM of the controller 31.

Describing now the processes performed by the controller 31, in this embodiment, instead of the Process #7 of the third embodiment, the following Processes #7–#10 shown below are performed.

Process #7: The controller 31 calculates a surface area ratio f1(Lvq) for each interval based on a lift amount Lvq for each interval stored in the ROM.

Process #8: The controller 31 integrates the direct blow-in rate KXD3 using the following equation (77) from a surface area ratio f1(Lvq) for each interval:

$$KXD3=\Sigma f1(Lvq) \tag{77}$$

The integration of equation (77) is performed during an interval from when the intake valve 15 starts to open, to when the intake valve 15 has fully closed.

Process #9: The correction value XI2 of the injected fuel density is calculated by looking up a map having the characteristics shown in FIG. 41 which is pre-stored in the ROM, from the maximum lift amount Lvmax of the intake valve 15.

Process #10: The ratio XD (%) from the fuel which is directly blown into the combustion chamber 5 is calculated by the following equation (78) using the direct blow-in rate KXD3 and the correction value XI2 of the injected fuel density:.

$$XD=XGA\cdot KXD3\cdot XI2 \tag{78}$$

According to this embodiment, the direct blow-in rate KXD3 and the correction value XI2 of the injected fuel density are calculated as functions of the lift amount of the intake valve 15, so even for a lift valve having a different lift amount, it is not necessary to experimentally re-adjust the direct blow-in rate and correction value of the injected fuel density.

Instead of determining the direct blow-in rate KXD3 by integrating the surface area ratio f1 (Lvn) for each interval, it can also be determined based on the maximum value of the gap width x. Alternatively, it can be determined based on the surface area of the gap shown in FIG. 39.

According to this embodiment, the injected fuel was assumed to have a conical profile, but the injected fuel profile may also be assumed to be cylindrical.

In this case, the surface area ratio Ks is calculated by the following equations (79) and (80).

$$x\approx Lv\cdot\sin\beta \tag{79}$$

$$Ks=\frac{x}{Dp}=Lv\cdot\frac{\sin\beta}{Dp}=f2(Lvq) \tag{80}$$

In this way, by considering the injected fuel profile to be cylindrical, the calculation of the surface area ratio Ks can be simplified.

Next, a fifth embodiment of this invention will be described.

In the first embodiment, the fuel vaporization rate X01 immediately after injection was calculated by equation (19). This embodiment relates to the method of estimating the temperature T for calculating the vaporization characteristic f(V,T,P) in equation (19).

In the first embodiment, the intake air temperature detected by the intake air temperature sensor 44, or the average value of the cooling water temperature Tw detected by the water temperature sensor 45 and the intake air temperature, was used as the temperature T.

In this embodiment, a gas temperature estimation value Tm calculated by the following equation (81) is used as the temperature T. The gas temperature estimation value Tm is the temperature of the gas flowing from the intake port 4 to the combustion chamber 5:

$$Tm=Tin\cdot(1-Kf)+Tf\cdot Kf \tag{81}$$

where, Tin=intake air temperature,

Tf=residual gas temperature, and

Kf=weighting coefficient.

The intake air temperature Tin uses the intake air temperature detected by the intake air temperature sensor 44.

The weighting coefficient Kf is a value depending on the residual gas ratio in the combustion chamber 5. Residual gas means recirculation gas due to external exhaust gas recirculation or internal exhaust gas recirculation. When the residual gas ratio is zero, the gas temperature Tm is equal to the intake air temperature Tin. The higher the residual gas ratio is, the nearer the gas temperature Tm to the residual gas temperature Tf is. Equation (81) is based on this concept.

The exhaust gas temperature detected by the exhaust gas sensor 48 may be used as the residual gas temperature Tf. The exhaust gas temperature Tf may also be estimated according to the running conditions of the internal combustion engine 1.

The residual gas ratio is a constant value, or a value estimated by a method known in the art.

Next, a sixth embodiment of this invention will be described.

In the first embodiment, with respect to the intake valve wall flow, the ratio Y0 of the vaporization amount, the ratio Y1 of the fuel that becomes wall flow on the combustion chamber high temperature wall surface and the ratio Y2 of the fuel that becomes wall flow on the combustion chamber low temperature wall surface are calculated by equations (45)–(47), and with respect to the intake port wall flow, the ratio Z0 of vaporization amount, the ratio Z1 of the fuel that becomes wall flow on the combustion chamber high temperature wall surface, and the ratio Z2 of the fuel that becomes wall flow on the combustion chamber low temperature wall surface, are calculated by equations (48)–(50).

This embodiment relates to a method of determining the temperature T used in these calculations.

In this embodiment, a temperature Tfw1 calculated by the following equation (82) is used as the temperature T used for calculating the values Y0, Y1, Y2 relating to intake valve wall flow. Also, a temperature Tfw2 calculated by the following equation (83) is used as the temperature T used for calculating the values Z0, Z1, Z2 relating to intake port wall flow:

$$Tm=Tin\cdot(1-Kt)+Tf\cdot Kf \quad (82)$$

where, Tfw1=calculation temperatures for Y0, Y1, Y2,

Tm=gas temperature estimation value,

Tw1=estimation value of temperature of part 15*b* of intake valve 15, and Kfw1=weighting coefficient.

$$Tfw2=Tm\cdot(1-Kfw2)+Tw2\cdot Kfw2 \quad (83)$$

where, TfW2=calculation temperatures for Z0, Z1, Z2,

TW2=estimation value of temperature of wall surface 4*a* of intake port 4, and KfW2=weighting coefficient.

The estimation value Tw1 of the temperature of the part 15*b* of the intake valve 15 can be calculated by the method disclosed in Tokkai Hei 3-134237 mentioned in the first embodiment. As the estimation value of the temperature of the wall surface 4*a* of the intake port 4, the cooling water temperature Tw or a temperature lower by a fixed amount than the cooling water temperature Tw, is used. The fixed amount may for example be 15 degrees Centigrade. The gas temperature estimation value Tm is estimated by equation (81) in an identical manner to that of the fifth embodiment. The weighting coefficients Kfw1, KfW2 are determined in advance by adaptation experiments.

Next, a seventh embodiment of this invention will be described.

In the first embodiment, a vaporized burnt amount V0 and vaporized unburnt exhaust amount V1 relating to the combustion chamber high temperature wall flow, are calculated by equations (51), (52), and a vaporized burnt amount W0 and vaporized unburnt exhaust amount V1 relating to the combustion chamber low temperature wall flow, are calculated by equations (53), (54).

This embodiment relates to the method of calculating the temperature T used in these calculations.

In this embodiment, a temperature Tfw3 calculated by the following equation (84) is used as the temperature T used for calculating the values V0, V1 relating-to combustion chamber high temperature wall flow. A temperature Tfw4 calculated by the following equation (85) is used as the temperature T used for calculating the values W0, W1 relating to combustion chamber low temperature wall flow:

$$Tfw3=Tm\cdot(1-Kfw3)+Tw3\cdot Kfw3 \quad (84)$$

where, Tfw3=calculation temperatures for V0, V1,

Tm=gas temperature estimation value,

Tw3=estimation value of temperature of combustion chamber high temperature wall surface, and Kfw3=weighting coefficient.

$$Tfw4=Tm\cdot(1-Kfw4)+Tw4\cdot Kfw4 \quad (85)$$

where, TfW4=calculation temperatures for W0, W1,

TW4=estimation value of temperature of combustion chamber low temperature wall surface, and Kfw4=weighting coefficient.

The exhaust gas temperature detected by the exhaust gas temperature sensor 48 may be used as the estimation temperature Tw3 of the combustion chamber high temperature wall surface. The cooling water temperature Tw detected by the water temperature sensor 45 may be used as the estimation value Tw4 of the temperature of the combustion chamber low temperature wall surface.

The gas temperature estimation value Tm is estimated by equation (80) which is identical to that of the fifth embodiment. The weighting coefficients Kfw3, Kfw4 are determined in advance by adaptation experiments.

The contents of Tokugan 2003-279030, with a filing date of Jul. 24, 2003 in Japan, Tokugan 2003-285252 with a filing date of Aug. 1, 2003 in Japan, and Tokugan 2003-298763 with a filing date of Aug. 22, 2003 in Japan are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

The embodiments of this invention in which an exclusive property or privilege is claimed are defined as follows:

What is claimed is:

1. A fuel injection control device for an internal combustion engine, the engine comprising a combustion chamber connected to an intake port via an intake valve, the device comprising:

a fuel injector provided in the intake port which injects a volatile liquid fuel; and a programmable controller programmed to:

determine a particle diameter of the fuel injected from the fuel injector;

calculate a suspension ratio of the injected fuel in the combustion chamber according to the particle diameter;

calculate a burnt fuel amount burnt in the combustion chamber based on the suspension ratio;

calculate a target fuel injection amount based on the burnt fuel amount; and control the fuel injection amount of the fuel injector based on the target fuel injection amount.

2. The fuel injection control device as defined in claim 1, wherein the suspension ratio means the sum total mass of vaporized fuel and the fuel which remains in the air as a mist.

3. The fuel injection control device as defined in claim 1, wherein the controller is further programmed to calculate the suspension ratio of the injected fuel to be higher, the smaller the particle diameter of the injected fuel is.

4. The fuel injection control device as defined in claim 1, wherein the controller is further programmed to determine a particle size distribution of the fuel injected from the fuel injector, and to calculate the suspension ratio of the injected fuel according to the particle size distribution.

5. The fuel injection control device as defined in claim 4, wherein the controller is further programmed to classify the particle diameter of the injected fuel into plural regions, and calculate the suspension ratio of the injected fuel by integrating the suspension ratio for each region obtained by multiplying a mass ratio of the fuel particles of each region by the suspension ratio for each region.

6. The fuel injection control device as defined in claim 1, wherein the controller is further programmed to determine an average particle diameter of the fuel injected from the fuel injector, and to calculate the suspension ratio of the injected fuel according to the average particle diameter.

7. The fuel injection control device as defined in claim 1, wherein the controller is further programmed to calculate the suspension ratio of the injected fuel from a ratio of suspended fuel formed directly by the injected fuel, a ratio of vaporized fuel which vaporizes from a fuel adhering to the intake port, a ratio of vaporized fuel which vaporizes from a fuel adhering to the intake valve, and a ratio of vaporized fuel which vaporizes from a fuel adhering to a wall surface in the combustion chamber.

8. The fuel injection control device as defined in claim 7, wherein the controller is further programmed to calculate the suspension ratio of the injected fuel formed directly by the injected fuel, as the sum of a ratio of fuel vaporized in the intake port, a ratio of fuel suspended in the intake port, and a ratio of the fuel blown into the combustion chamber which is suspended in the combustion chamber.

9. The fuel injection control device as defined in claim 8, wherein the controller is further programmed to determine the ratio of fuel vaporized in the intake port according to parameters including a temperature of the intake port, a gas pressure of the intake port and a gas flow velocity of the intake port.

10. The fuel injection control device as defined in claim 8, wherein the controller is further programmed to determine the ratio of fuel suspended in the intake port by classifying the particle diameter of the injected fuel into plural regions, determining a descent velocity of the fuel particles suspended in the intake port for each particle diameter region, calculating the suspension ratio of particles for each region based on a descent distance in a predetermined time, and integrating the suspension ratio of the particles for each region.

11. The fuel injection control device as defined in claim 10, wherein the internal combustion engine comprises a four-stroke cycle engine which repeats an intake stroke, a compression stroke, an expansion stroke and an exhaust stroke in sequence, and the predetermined time is set equal to a time from a start of fuel injection by the fuel injector to a start of the compression stroke.

12. The fuel injection control device as defined in claim 10, wherein the descent velocity of fuel particles suspended in the intake port is set to increase as the particle diameter of the injected fuel increases.

13. The fuel injection control device as defined in claim 12, wherein the controller is further programmed to determine the ratio of fuel blown into the combustion chamber which is suspended in the combustion chamber, by classifying the particle diameter of fuel blown into the combustion chamber into plural regions, determining a descent velocity of the fuel particles suspended in the combustion chamber for each region, calculating the suspension ratio of particles for each region based on a descent distance in a second predetermined time, and integrating the suspension ratios of the particles for each region.

14. The fuel injection control device as defined in claim 13, wherein the internal combustion engine comprises a four-stroke cycle engine which repeats an intake stroke, a compression stroke, an expansion stroke and an exhaust stroke in sequence, and the second predetermined time is set equal to a time from a start of fuel injection by the fuel injector to an end of the compression stroke.

15. The fuel injection control device as defined in claim 13, wherein the descent velocity of fuel particles suspended in the combustion chamber is set to increase as the particle diameter of the fuel blown into the combustion chamber increases.

16. The fuel injection control device as defined in claim 7, wherein the controller is further programmed to determine the ratio of vaporized fuel which vaporizes from the fuel adhering to the intake port according to parameters including a temperature of the intake port, a pressure of the intake port and a gas flow velocity of the intake port.

17. The fuel injection control device as defined in claim 7, wherein the controller is further programmed to determine the ratio of vaporized fuel which vaporizes from the fuel adhering to the intake valve according to parameters including a temperature of the intake valve, a pressure of the intake port and a gas flow velocity of the intake port.

18. The fuel injection control device as defined in claim 7, wherein the controller is further programmed to determine the ratio of vaporized fuel which vaporizes from the fuel adhering to the wall surface in the combustion chamber according to parameters including a temperature of the combustion chamber, a pressure of the combustion chamber and a gas flow velocity of the combustion chamber.

19. The fuel injection control device as defined in claim 18, wherein the combustion chamber is partitioned by a low temperature wall surface, and a high temperature wall surface other than the low temperature wall surface, and the controller is further programmed to calculate the ratio of vaporized fuel which vaporizes from the fuel adhering to the wall surface in the combustion chamber as a ratio of vaporized fuel which vaporizes from the fuel adhering to the low temperature wall surface, and a ratio of vaporized fuel which vaporizes from the fuel adhering to the high temperature wall surface.

20. The fuel injection control device as defined in claim 8, wherein the controller is further programmed to calculate a ratio of fuel blown into the combustion chamber based on a fuel injection timing of the fuel injector, and an angle subtended by the fuel injector and the intake valve.

21. The fuel injection control device as defined in claim 8, wherein the controller is further programmed to calculate the ratio of fuel suspended in the intake port by classifying the particle diameter of the injected fuel into plural particle diameter regions, determining a penetration rate of the fuel particles for each particle diameter region, calculating an arrival distance of the fuel particles within a predetermined time for each particle diameter region from the penetration rate, and integrating a mass ratio of fuel particles for which the arrival distance within the predetermined time does not reach a distance between the fuel injector and intake valve over the particle diameter regions.

22. The fuel injection control device as defined in claim 21, wherein the controller is further programmed to determine that the penetration rate of particles of the injected fuel increases, the larger the particle diameter of the injected fuel is.

23. The fuel injection control device as defined in claim 21, wherein the internal combustion engine comprises a four-stroke cycle engine which repeats an intake stroke, a compression stroke, an expansion stroke and an exhaust stroke in sequence, and the predetermined time is set equal to a time from a start of fuel injection by the fuel injector to a start of the compression stroke.

24. The fuel injection control device as defined in claim 21, wherein the controller is further programmed to calculate a mass ratio of fuel particles adhering to the intake valve by integrating a value obtained by multiplying a mass ratio of fuel particles for which the arrival distance within the predetermined time exceeds the distance between the fuel injector and intake valve, by a predetermined intake valve direct adhesion coefficient, over the particle diameter regions.

25. The fuel injection control device as defined in claim 24, wherein the controller is further programmed to calculate a mass ratio of fuel suspended in the combustion chamber, by determining a combustion chamber suspension particle diameter region for which the arrival distance within the predetermined time is equal to or more than the distance between the fuel injector and intake valve and less than a distance between the fuel injector and the wall surface of the combustion chamber, and integrating a difference between the mass ratio of fuel particles for which the arrival distance within the predetermined time exceeds the distance between the fuel injector and the intake valve, and a value obtained by multiplying the mass ratio of fuel particles for which the arrival distance within the predetermined time exceeds the distance between the fuel injector and the intake valve by an intake valve direct adhesion rate, over the combustion chamber suspension particle diameter regions.

26. The fuel injection control device as defined in claim 24, wherein the controller is further programmed to calculate a mass ratio of fuel adhering to the wall surface of the combustion chamber, by determining a combustion chamber adhesion particle diameter region for which the arrival distance within the predetermined time exceeds the distance between the fuel injector and the wall surface of the combustion chamber, and integrating the difference between the mass ratio of fuel particles for which the arrival distance within the predetermined time exceeds the distance between the fuel injector and the intake valve, and a value obtained by multiplying the mass ratio of fuel particles for which the arrival distance within the predetermined time exceeds the distance between the fuel injector and the intake valve by an intake valve direct adhesion rate, over the combustion chamber adhesion particle diameter regions.

27. The fuel injection control device as defined in claim 8, wherein the controller is further programmed to determine an average particle diameter of the fuel injected from the fuel injector, determine a velocity of the fuel injected by the fuel injector based on the average particle diameter, calculate a ratio of the fuel blown into the combustion chamber which remains suspended in the combustion chamber in unit time as a unit combustion chamber suspension ratio, which increases from a first time when a leading edge of the injected fuel passes through the intake valve to a second time when the leading edge of the injected fuel reaches the wall surface of the combustion chamber, and decreases from a third time when a trailing edge of the injected fuel passes through the intake valve to a fourth time when the trailing edge of the injected fuel reaches the wall surface of the combustion chamber, for each time region per unit time from the first time to the fourth time, calculate a latent combustion chamber suspension mass ratio by integrating the product of the mass ratio of fuel blown into the combustion chamber for each time region and the unit combustion chamber suspension ratio over the time regions, and calculate a mass ratio of fuel blown into the combustion chamber by multiplying the latent combustion chamber suspension mass ratio by a predetermined ratio.

28. The fuel injection control device as defined in claim 27, wherein the controller is further programmed, when the second time occurs after the third time, to calculate the unit combustion chamber suspension ratio as a constant value from the third time to the second time.

29. The fuel injection control device as defined in claim 28, wherein the controller is further programmed to calculate a mass ratio in unit time of fuel blown into the combustion chamber, as a value obtained by subtracting a fuel amount which vaporizes in the intake port in unit time, from the fuel injection amount of the fuel injector in unit time.

30. The fuel injection control device as defined in claim 29, wherein the controller is further programmed to determine the mass ratio of fuel vaporized in the intake port according to parameters including a temperature of the intake port, a gas pressure of the intake port and a gas flow velocity of the intake port.

31. The fuel injection control device as defined in claim 30, wherein the internal combustion engine comprises an exhaust valve which discharges a combustion gas of the combustion chamber, the valve-opening timing of the intake valve being set to precede the closing timing of the exhaust valve, and the controller is further programmed to calculate the gas flow velocity of the intake port, as a flow velocity of fuel injected by the fuel injector relative to a difference between a flow velocity of combustion gas of the combustion chamber blown back from the intake valve to the intake port, and a flow velocity of intake air aspirated to the combustion chamber via the intake valve.

32. The fuel injection control device as defined in claim 27, wherein the controller is further programmed to calculate the predetermined ratio by multiplying a direct blow-in rate which varies according to a lift amount of the intake valve, by a value for correcting an injected fuel density which varies according to a maximum lift amount of the intake valve.

33. The fuel injection control device as defined in claim 9, wherein the fuel injection control device further comprises an intake air temperature sensor which detects an intake air temperature of the internal combustion engine, and the controller is further programmed to estimate the temperature of the intake port based on the intake air temperature.

34. The fuel injection control device as defined in claim 33, wherein the controller is further programmed to estimate a temperature of a gas flowing through the intake port by taking a weighted average with a predetermined weighting coefficient of a residual gas temperature and the intake air temperature, the residual gas being an exhaust gas mixing with an intake air of the intake port, and using the temperature of the gas flowing through the intake port as the temperature of the intake port.

35. The fuel injection control device as defined in claim 34, wherein the fuel injection control device further comprises an exhaust gas temperature sensor which detects an exhaust gas temperature of the internal combustion engine, and the controller is further programmed to use the exhaust gas temperature as the residual gas temperature of the combustion chamber.

36. The fuel injection control device as defined in claim 34, wherein the controller is further programmed to set the weighting coefficient so that the temperature of the intake port approaches the temperature of the residual gas, as a ratio of the residual gas in the combustion chamber increases.

37. The fuel injection control device as defined in claim 16, wherein the combustion chamber is formed inside a cylinder cooled by cooling water, the fuel injection control device further comprises an intake air temperature sensor which detects an intake air temperature of the internal combustion engine, and a water temperature sensor which detects a cooling water temperature of the internal combustion engine, and the controller is further programmed to estimate a temperature of a gas flowing through the intake port by taking a weighted average with a predetermined weighting coefficient of a residual gas temperature and the intake air temperature, the residual gas being an exhaust gas mixing with an intake air of the intake port, calculate a calculation temperature by taking a weighted average with another weighting coefficient of a wall surface temperature of the intake port estimated from the cooling water temperature and the temperature of the gas flowing through the intake port, and determine a ratio of vaporized fuel which vaporizes from a fuel which has adhered to the intake port based on the calculation temperature.

38. The fuel injection control device as defined in claim 37, wherein the fuel injection control device further comprises an exhaust gas temperature sensor which detects an exhaust gas temperature of the internal combustion engine, and the controller is further programmed to use the exhaust gas temperature as the temperature of the residual gas in the combustion chamber.

39. The fuel injection control device as defined in claim 17, wherein the fuel injection control device further comprises an intake air temperature sensor which detects an intake air temperature of the internal combustion engine, and the controller is further programmed to estimate a temperature of a gas flowing through the intake port by taking a weighted average with a predetermined weighting coefficient of a residual gas temperature and the intake air temperature, the residual gas being an exhaust gas mixing with the intake air of the intake port, calculate a calculation temperature by taking a weighted average with another weighting coefficient of the temperature of the intake valve and the temperature of the gas flowing through the intake port, and determine a ratio of vaporized fuel which vaporizes from a fuel which has adhered to the intake valve based on the calculation temperature.

40. The fuel injection control device as defined in claim 39, wherein the fuel injection control device further comprises an exhaust gas temperature sensor which detects an exhaust gas temperature of the internal combustion engine, and the controller is further programmed to use the exhaust gas temperature as the temperature of the residual gas in the combustion chamber.

41. The fuel injection control device as defined in claim 19, wherein the combustion chamber is formed inside a cylinder cooled by cooling water, the low temperature wall surface comprises a wall surface of the cylinder, and the fuel injection control device further comprises a water temperature sensor which detects a cooling water temperature, and the controller is further programmed to estimate a temperature of a gas flowing through the intake port by taking a weighted average with a predetermined weighting coefficient of a residual gas temperature and an intake air temperature, the residual gas being an exhaust gas mixing with the intake air of the intake port, calculate a calculation temperature by taking a weighted average with another weighting coefficient of the cooling water temperature and the temperature of the gas flowing through the intake port, and determine a ratio of vaporized fuel which vaporizes from a fuel which has adhered to the low temperature part based on the calculation temperature.

42. The fuel injection control device as defined in claim 40, wherein the fuel injection control device further comprises an exhaust gas temperature sensor which detects an exhaust gas temperature of the internal combustion engine, and the controller is further programmed to use the exhaust gas temperature as the temperature of the residual gas in the combustion chamber.

43. The fuel injection control device as defined in claim 19, wherein the combustion chamber is formed inside a cylinder cooled by cooling water, a high temperature wall surface comprises a wall surface of the combustion chamber other than the wall surface of the cylinder, and the fuel injection control device further comprises an exhaust gas temperature sensor which detects an exhaust gas temperature of the internal combustion engine, and the controller is further programmed to estimate the temperature of a gas flowing through the intake port by taking a weighted average with a predetermined weighting coefficient of a residual gas temperature and an intake air temperature, the residual gas being an exhaust gas mixing with an intake air of the intake port, calculate a calculation temperature by taking a weighted average with another weighting coefficient of the exhaust gas temperature and the temperature of the gas flowing through the intake port, and determine a ratio of vaporized fuel which vaporizes from a fuel which has adhered to the high temperature wall surface based on the calculation temperature.

44. The fuel injection control device as defined in claim 43, wherein the fuel injection control device further comprises an exhaust gas temperature sensor which detects an exhaust gas temperature of the internal combustion engine, and the controller is further programmed to use the exhaust gas temperature as the temperature of the residual gas in the combustion chamber.

45. A fuel injection control device for an internal combustion engine, the engine comprising a combustion chamber connected to an intake port via an intake valve, the device comprising:

a fuel injector provided in the intake port which injects a volatile liquid fuel;

means for determining a particle diameter of the fuel injected from the fuel injector;

means for calculating a suspension ratio of the injected fuel in the combustion chamber according to the particle diameter;

means for calculating a burnt fuel amount burnt in the combustion chamber based on the suspension ratio;

means for calculating a target fuel injection amount based on the burnt fuel amount; and means for controlling the fuel injection amount of the fuel injector based on the target fuel injection amount.

46. A fuel injection control method for an internal combustion engine, the engine comprising a combustion chamber connected to an intake port via an intake valve and a fuel injector provided in the intake port which injects a volatile liquid fuel, the method comprising:

determining a particle diameter of the fuel injected from the fuel injector;

calculating a suspension ratio of the injected fuel in the combustion chamber according to the particle diameter;

calculating a burnt fuel amount burnt in the combustion chamber based on the suspension ratio;

calculating a target fuel injection amount based on the burnt fuel amount; and controlling the fuel injection amount of the fuel injector based on the target fuel injection amount.

* * * * *